United States Patent [19]

Yoshizawa et al.

[11] Patent Number: 5,006,437

[45] Date of Patent: Apr. 9, 1991

[54] METHOD OF IMAGE FORMATION USING A SILVER AHLIDE COLOR PHOTOGRAPHIC MATERIAL

[75] Inventors: Tomomi Yoshizawa; Nariko Kimura, both of Hino, Japan

[73] Assignee: Konica Corporation, Tokyo, Japan

[21] Appl. No.: 400,494

[22] Filed: Aug. 30, 1989

[30] Foreign Application Priority Data

Sep. 2, 1988 [JP] Japan ..... 63-220757

[51] Int. Cl.[5] ..... G03C 7/00

[52] U.S. Cl. ..... 430/359; 430/467; 430/384; 430/385; 430/552; 430/553; 430/551; 430/546

[58] Field of Search ..... 430/467, 384, 385, 359, 430/552, 553, 551, 546

[56] References Cited

U.S. PATENT DOCUMENTS

| | | | |
|---|---|---|---|
| 2,835,579 | 5/1958 | Thirtle et al. | 430/546 |
| 4,551,422 | 11/1985 | Kimura et al. | 430/552 |
| 4,774,169 | 9/1988 | Kuse et al. | 430/467 |
| 4,828,970 | 5/1989 | Kuse et al. | 430/385 |
| 4,833,069 | 5/1989 | Hamada et al. | 430/552 |
| 4,837,139 | 6/1989 | Kobayashi et al. | 430/552 |
| 4,882,267 | 11/1989 | Hirabayashi et al. | 430/552 |

FOREIGN PATENT DOCUMENTS

| | | | |
|---|---|---|---|
| 178258 | 3/1987 | Japan | 430/546 |

*Primary Examiner*—Richard L. Schilling
*Assistant Examiner*—Thomas R. Neville
*Attorney, Agent, or Firm*—Jordan B. Bierman

[57] ABSTRACT

A process for forming a color image is disclosed. In the process a photographic material which comprises a light-sensitive silver halide emulsion layer containing a 2,5-diacylaminophenol-based cyan coupler at a ratio of over 50 mol % of the total cyan coupler is processed with a color developer containing a color developing agent represented by Formula I at a ratio of over 55 mol % of total developing agent in the color developer,

I wherein $R_1$ and $R_2$ independently represent a substituted or unsubstituted alkyl group, and $R_1$ and $R_2$ may link together to form a ring.

9 Claims, No Drawings

METHOD OF IMAGE FORMATION USING A SILVER AHLIDE COLOR PHOTOGRAPHIC MATERIAL

FIELD OF THE INVENTION

The present invention relates to a method of color image formation using a silver halide color photographic material that provides images with improved tone for cyan images, more specifically to a method of color image formation using a silver halide color photographic material that provides a good tone when used as color proof for printing.

BACKGROUND OF THE INVENTION

When a exposed silver halide color photographic light sensitive material is developed, dyes are produced by coupling between the color developing agent oxidation product resulting from the development of the silver halide and the coupler. The color reproducibility of color printing paper etc. using such a coupling reaction to provide color images depends largely upon the coupler and color developing agent. Known cyan couplers commonly used in silver halide color photographic light sensitive materials such as color printing paper include 2,5-diacylaminophenol-based cyan couplers and phenol-based cyan couplers having both an acylamino group at 2-position and an alkyl group at 5-position.

N,N-di-substituted paraphenylenediamine compounds are widely used as color developing agents. 3-ethyl-4-amino-N-ethyl-N-(β-methanesulfonamidoethyl)-aniline sulfate is a well-known color developing agent for photographic materials containing such a cyan coupler.

However, such a cyan dye obtained by using a cyan coupler and a color developing agent in combination does not permit provision of high chromaticness because of high absorption of blue light and green light due to spectral broadening on the short wave side.

Japanese Patent O.P.I. Publication No. 96656/1988 discloses a method of improving color reproducibility by reducing green light absorbance by increasing the maximum absorption wavelength of formed dye by the use of a sulfonamide compound and a diacylaminophenol-based cyan coupler in combination.

This method permits improvement in cyan tone, but the spectral broadening on the short wave side remains intact to a rather high degree and thus reduces green light absorbance. This drawback has been expected to be overcome.

The method disclosed in Japanese Patent O.P.I. Publication No. 96656/1988 permits lowering of the subabsorption of yellow light at 420 nm comparison with phenol-based cyan couplers having an alkyl group at 5-position, but it is desired that this subabsorption is further lessened to improve color reproducibility.

Such improvement in the spectral absorption characteristic of cyan dye significantly affects the color reproducibility of ordinary color prints. Color photographic materials are also used to prepare color proofs from color-separated black-and-white dot images used in the printing and processing processes. In this case, the spectral absorption characteristic of cyan images plays a key role. Accordingly, in general, the cyan dye for printing ink has a vivid color because its spectral broadening on the short wave side below the maximum absorbance wavelength is small and, in addition, the blue light absorbance is low, while the cyan dye obtained by color development of a coupler has a fault that the produced color looks more clouded than the color of printing ink and/or looks greenish because the blue light and green light absorbance is high.

SUMMARY OF THE INVENTION

The object of the present invention is to provide a method of image formation using a silver halide color photographic material with excellent color reproducibility, specifically a method of forming cyan images with lessened subabsorption of blue light and green light.

More specifically, the object of the present invention is to provide a method of forming cyan images with excellent tone suitable for color proofs for printing.

In the present invention, the silver halide photographic light sensitive material has a silver halide emulsion layer containing 2,5-diacylaminophenol-based cyan coupler at a ratio of over 50 mol % of the total cyan coupler content. It is subjected to imagewise exposure for color image formation and developed with a developer containing a developing agent represented by Formula I at a ratio of over 55 mol % of the total developing agent content.

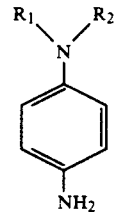

I wherein $R_1$ and $R_2$ independently represent a substituted or a unsubstituted alkyl group, whether identical or not, and $R_1$ and $R_2$ may link together to form a ring.

The developing agent of Formula I for the present invention preferably has a water-soluble group for one of $R_1$ and $R_2$ more preferably has an unsubstituted alkyl group for $R_1$ and a hydroxyalkyl group for $R_2$.

The object of the present invention is efficiently accomplished when the silver halide emulsion layer containing the cyan coupler contains at least one of compounds represented by Formula II or VI.

$$R_3—NH—R_4 \qquad \text{II}$$

wherein $R_3$ and $R_4$ independently represent a hydrogen atom or monovalent organic group. At least one of $R_3$ and $R_4$ is an electron-attracting group. $R_3$ and $R_4$ may link together to form a ring in cooperation with —NH—.

VI

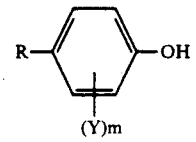

wherein R represents an alkyl group, alkoxycarbonyl group, arylsulfonylamino group or alkylsulfonylamino group; Y represents a halogen atom or a group that substitutes a hydrogen atom on the benzene ring; m represents an integer of 0 to 4.

The examples of preferable water-soluble group for $R_1$ or $R_2$ in Formula I include —$(CH_2)_n$—$CH_2OH$, —$(CH_2)_m$—$NHSO_2$—$(CH_2)_n$—$CH_3$, —$(CH_2)_m$—O—$(CH_2)_n$—$CH_3$, —$(CH_2CH_2O)_nC_mH_{2m+1}$, —COOH group, and —$SO_3H$ group (wherein m and n independently represent an integer of 0 or more).

The alkyl group represented by $R_1$ or $R_2$ has 1 to 6 carbon atoms. This alkyl group preferably has a water-soluble group as a substituent. Also, $R_1$ and $R_2$ may link together to form a 5- or 6-membered ring; the ring-forming atoms may include a carbon atom, a nitrogen atom bound directly to phenyl group, an oxygen atom, and a nitrogen atom. Of these rings, morpholine is preferable.

It is preferable that the compound of Formula I pair with an acid to form a salt.

The examples of preferable acids include inorganic acids such as sulfuric acid, hydrochloric acid and nitric acid, and organic acids such as p-toluenesulfonic acid.

DETAILED DESCRIPTION OF THE INVENTION

The color developing agent of Formula I for the present invention is exemplified below.

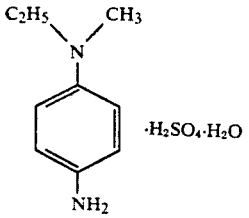

I-1

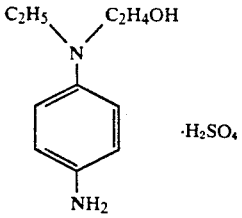

I-2

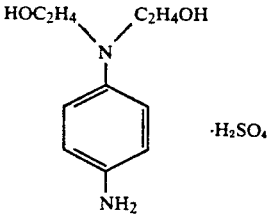

I-3

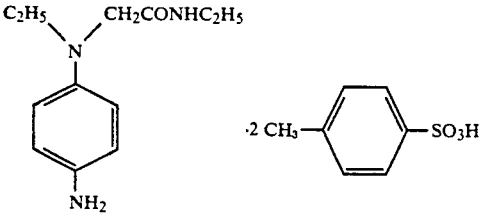

I-4

-continued

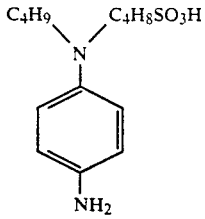

I-5

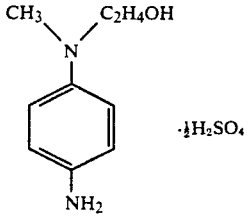

I-6

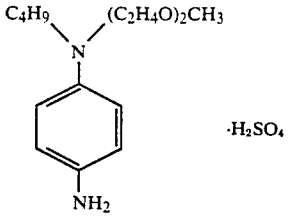

I-7

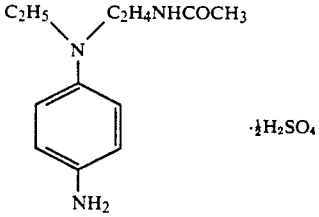

I-8

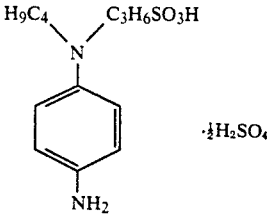

I-9

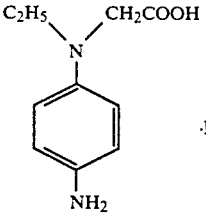

I-10

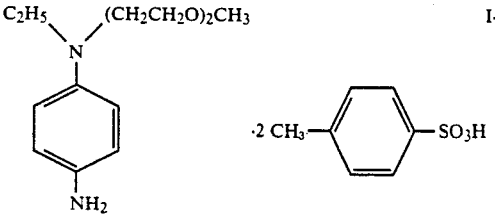

I-11

-continued

I-12

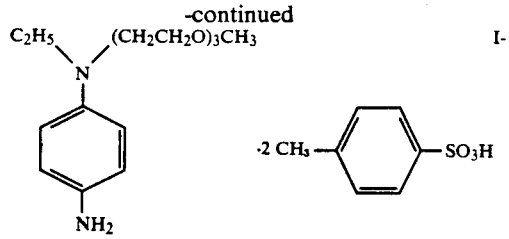

I-13

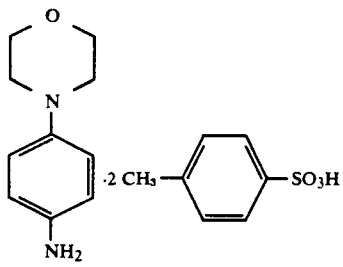

I-14

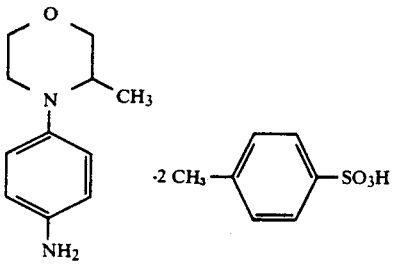

I-15

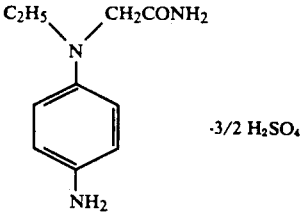

I-16

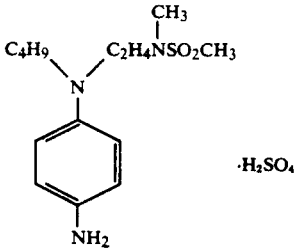

Of the examples of the color developing agent given above, I-2 is especially preferable for the present invention.

The compound of Formula I for the present invention can be synthesized in accordance with the method described in the Journal of the American Chemical Society, vol. 73, p. 3100.

The content of the compound of Formula I is over 55 mol % of the total developing agent content of the developer, preferably over 70 mol %, more preferably over 80 mol %, and ideally over 90 mol %.

The amount of the compound of Formula I contained in the color developer may be over $0.5\times10^{-2}$ mol per liter color developer, preferably $1.0\times10^{-2}$ to $1.0\times10^{-1}$ mol, and more preferably $1.5\times10^{-2}$ to $5.0\times10^{-2}$ mol.

In addition to the developing agent represented by Formula I, various developing agents may be used for the present invention. An example of such developing agents is represented by the following Formula I-a.

I-a

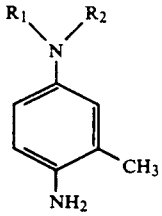

wherein $R^1$ and $R^2$ have the same definitions as Formula I.

The developing agent of Formula I-a is exemplified by 3-methyl-4-amino-N-ethyl-N-(β-methanesulfonamidoethyl)aniline sulfate and 3-methyl-4-amino-N-ethyl-N-(β-hydroxyethyl)-aniline sulfate.

The color developer containing the developing agent of Formula I of the present invention may contain the following components.

For example, sulfites, hydroxylamine compounds etc. can be used as preservatives.

When the color developer contains a compound represented by the following formula, crystal separation on the liquid surface in the color developer tank is suppressed, as well as the effect of the present invention is enhanced. This is a preferable mode of embodiment of the present invention.

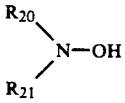

wherein $R_{20}$ and $R_{21}$ independently represent an alkyl group or hydrogen atom. $R_{20}$ and $R_{21}$ may be hydrogen atoms at a time. $R_{20}$ and $R_{21}$ may form a ring.

In the above formula, it is preferable that $R_{20}$ and $R_{21}$ are hydrogen atoms at a time. The alkyl groups represented by $R_{20}$ and $R_{21}$ may be identical or not, and each preferably has 1 to 3 carbon atoms. The alkyl groups for $R_{20}$ and $R_{21}$ include those having a substituent. Also, $R_{20}$ and $R_{21}$ may link together to form a ring, for example, a heterocyclic ring such as piperidine, piperazine or morpholine.

Some examples of the hydroxylamine derivative represented by the above formula are given in U.S. Pat. Nos. 3,287,125, 3,293,034, 3,287,124 etc. Examples of especially preferable compounds are given below.

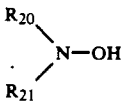

| Example compound No. | $R_{20}$ | $R_{21}$ |
|---|---|---|
| A 1 | $-C_2H_5$ | $-C_2H_5$ |
| A 2 | $-CH_3$ | $-CH_3$ |
| A 3 | $-C_3H_7$ | $-C_3H_7$ |
| A 4 | $-C_3H_7$(i) | $-C_3H_7$(i) |
| A 5 | $-CH_3$ | $-C_2H_5$ |
| A 6 | $-C_2H_5$ | $-C_3H_7$(i) |
| A 7 | $-CH_3$ | $-C_3H_7$(i) |
| A 8 | $-H$ | $-C_2H_5$ |
| A 9 | $-H$ | $-C_3H_7$ |
| A 10 | $-H$ | $-CH_3$ |

-continued

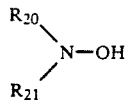

| Example compound No. | $R_{20}$ | $R_{21}$ |
|---|---|---|
| A 11 | $-H$ | $-C_3H_7(i)$ |
| A 12 | $-C_2H_5$ | $-C_2H_4OCH_3$ |
| A 13 | $-C_2H_4OH$ | $-C_2H_4OH$ |
| A 14 | $-C_2H_4SO_3H$ | $-C_2H_5$ |
| A 15 | $-C_2H_4COOH$ | $-C_2H_4COOH$ |
| A 16 | 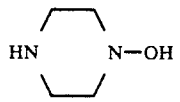 | |
| A 17 | 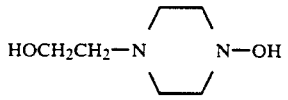 | |
| A 18 | 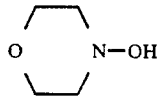 | |
| A 19 | 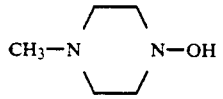 | |
| A 20 | $-CH_3$ | $-C_2H_4OCH_3$ |
| A 21 | $-C_2H_4OCH_3$ | $-C_2H_4OCH_3$ |
| A 22 | $-C_2H_4OC_2H_5$ | $-C_2H_4OC_2H_5$ |
| A 23 | $-C_3H_5OCH_3$ | $-C_3H_6OCH_3$ |
| A 24 | $-C_2H_5$ | $-C_2H_4OC_2H_5$ |
| A 25 | $-C_3H_7$ | $-C_2H_4OCH_3$ |
| A 26 | $-CH_3$ | $-C_2H_4OC_2H_5$ |
| A 27 | $-CH_3$ | $-CH_2OCH_3$ |
| A 28 | $-C_2H_5$ | $-CH_2OC_2H_5$ |
| A 29 | $-CH_2OCH_3$ | $-CH_2OCH_3$ |
| A 30 | $-C_2H_5$ | $-C_2H_4OC_3H_7$ |
| A 31 | $-C_3H_6OC_3H_7$ | $-C_3H_6OC_3H_7$ |

These compounds are normally used in the form of free amine, hydrochloride, sulfate, p-toluenesulfonate, oxalate, phosphate, acetate etc.

The concentration of this compound in color developer in normally 0.2 to 50 g/l, preferably 0.5 to 30 g/l, more preferably 1 to 15 g/l.

This compound can also be used in combination with hydroxylamine, which has conventionally been used.

When using hydroxylamine, quick developing with further preservability can be achieved in the presence of Br ions in an amount of less than $1\times10^{-3}$ mol in the color developer.

As developer components, it is possible to use alkali agents such as potassium hydroxide and trisodium phosphate, pH buffers such as sodium bicarbonate and borates, organic and inorganic antifogging agents, and development accelerators.

The diacylaminophenol-based cyan coupler for silver halide color photographic light sensitive material for the present invention is represented by Formula III.

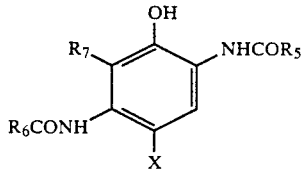

III wherein $R_5$ and $R_6$ independently represent an alkyl group, cycloalkyl group, alkenyl group, aryl group or heterocyclic group; $R_7$ represents a hydrogen atom, halogen atom, alkyl group or alkoxy group; $R_6$ and $R_7$ may cooperate together to form a ring; X represents a hydrogen atom or a group capable of splitting off by reaction with the oxidation product of color developing agent.

The above-mentioned diacylaminephenol-based cyan coupler of the present invention is preferably represented by Formula III-A.

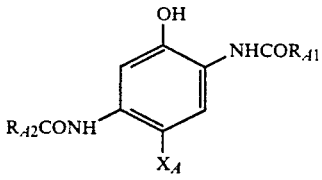

III-A wherein $R_{A1}$ represents a phenyl group substituted by at least one halogen atom, which may further have a substituent other than halogen atom; $R_{A2}$ represents an alkyl group, cycloalkyl group, alkenyl group, aryl group or heterocycle; $X_A$ represents a halogen atom, aryloxy group or alkoxy group, which may have a substituent. It is ideal that $R_{A1}$ is a phenyl group substituted by 2 to 5 halogen atoms.

Representative examples of the cyan coupler represented by Formula III are given below.

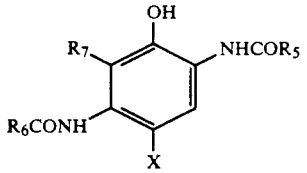
| Example compound number | $R_5$ | $R_6$ | $R_7$ | X |
|---|---|---|---|---|
| C-1 | $-(CF_2)_4H$ | 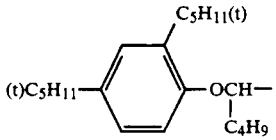 | H | —Cl |
| C-2 | 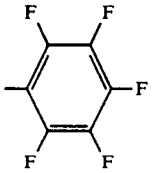 | 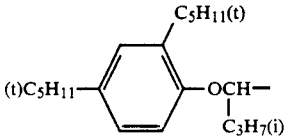 | H | —Cl |
| C-3 | 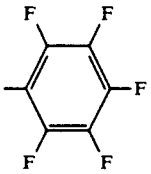 | 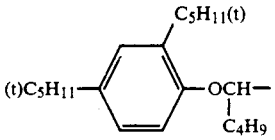 | H | —Cl |
| C-4 | 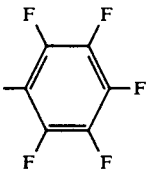 | $C_{16}H_{33}-$ | —Cl | —Cl |
| C-5 | 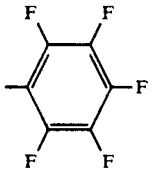 | 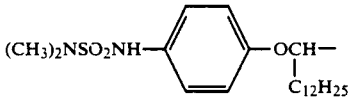 | H | 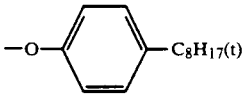 |
| C-6 | 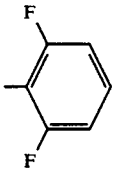 | 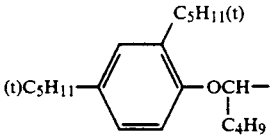 | H | H |
| C-7 | 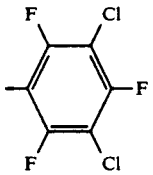 | 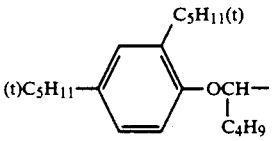 | H | —Cl |
| C-8 | 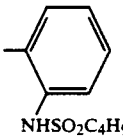 | 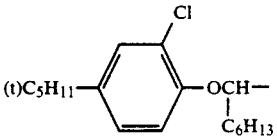 | H | —Cl |

-continued
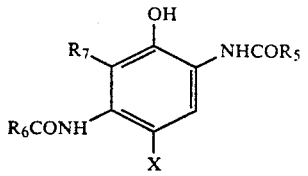
| Example compound number | $R_5$ | $R_6$ | $R_7$ | X |
|---|---|---|---|---|
| C-9 | 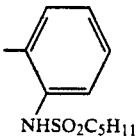 | 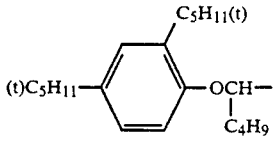 | H | 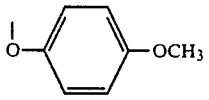 |
| C-10 | 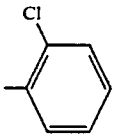 | 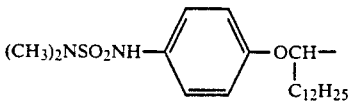 | H | —Cl |
| C-11 | 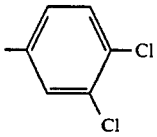 | 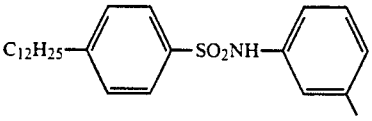 | H | —Cl |
| C-12 | 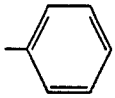 | 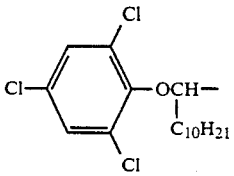 | H | $-OCH_2CONHC_3H_7$ |
| C-13 | 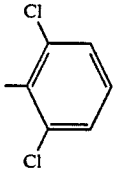 | 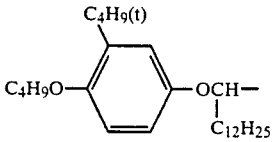 | H | —Cl |
| C-14 | 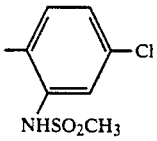 | 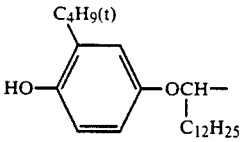 | H | —Cl |
| C-15 | 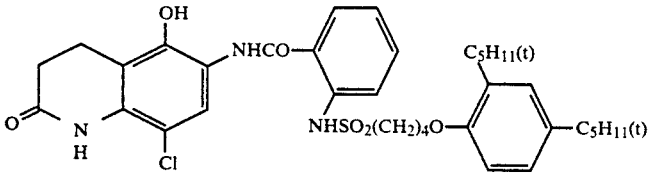 | | | |
| C-16 | 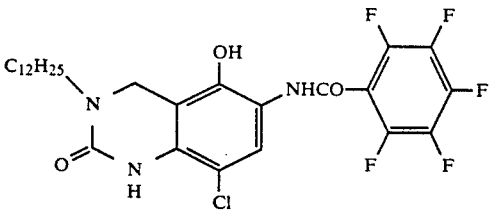 | | | |

-continued
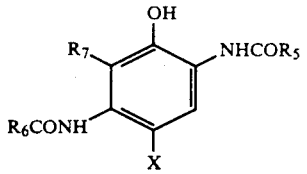
| Example compound number | $R_5$ | $R_6$ | $R_7$ | X |
|---|---|---|---|---|
| C-17 | 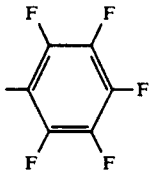 | 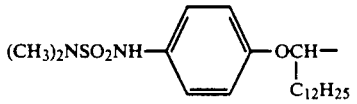 | H | —Cl |
| C-18 | 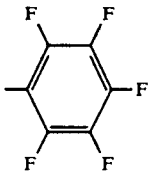 | 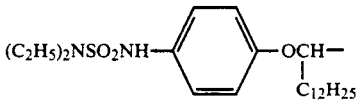 | H | —Cl |
| C-19 | 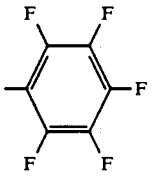 | 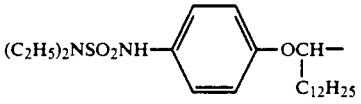 | H | 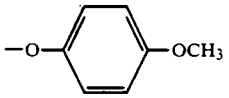 |
| C-20 | 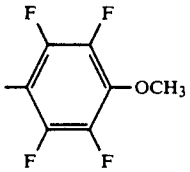 | 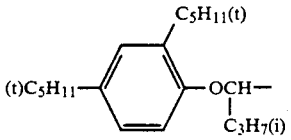 | H | —Cl |
| C-21 | 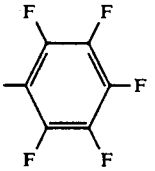 | 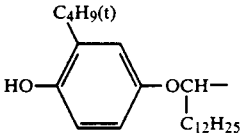 | H | —Cl |
| C-22 | 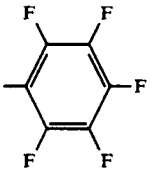 | 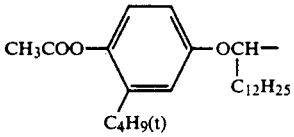 | H | —Cl |
| C-23 | 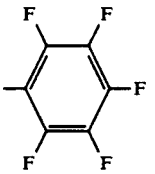 | 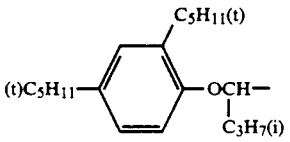 | H | 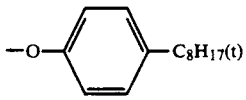 |
| C-24 | 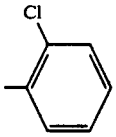 | 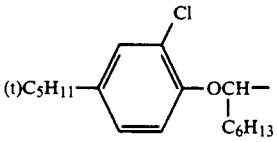 | H | —Cl |

-continued
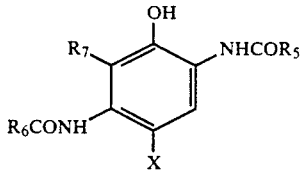
| Example compound number | $R_5$ | $R_6$ | $R_7$ | X |
|---|---|---|---|---|
| C-25 | 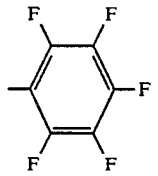 | 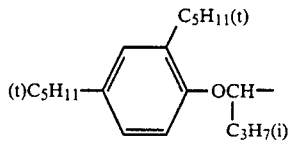 | H | $-OCH_2CONH(CH_2)_2OCH_3$ |
| C-26 | 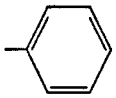 | 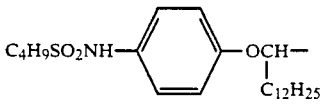 | H | $-Cl$ |
| C-27 | 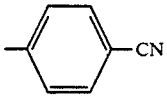 | 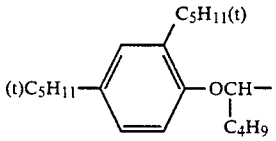 | H | H |
| C-28 | 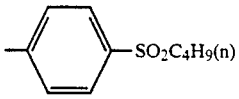 | 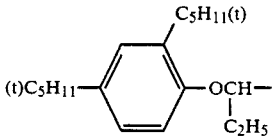 | H | H |
| C-29 | 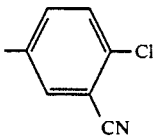 | 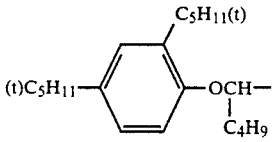 | H | H |
| C-30 | 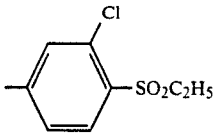 | 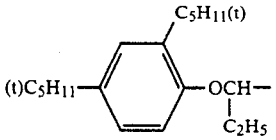 | H | Cl |
| C-31 | 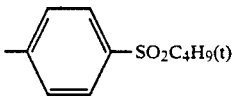 | 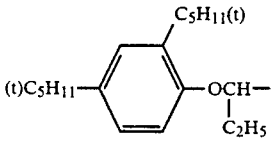 | H | $OCH_2CONH(CH_2)OCH_3$ |
| C-32 | 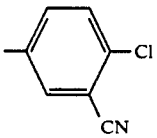 | 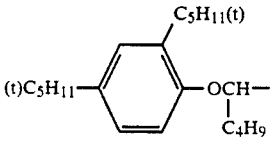 | H | 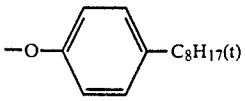 |
| C-33 | 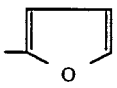 | 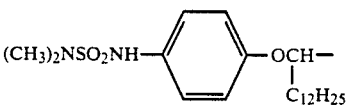 | H | Cl |

-continued

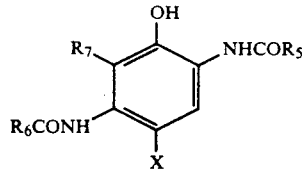

| Example compound number | $R_5$ | $R_6$ | $R_7$ | X |
|---|---|---|---|---|
| C-34 | 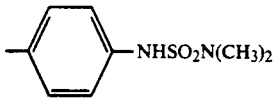 | 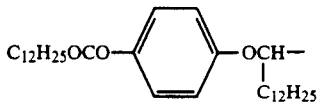 | H | Cl |
| C-35 | 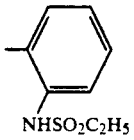 | 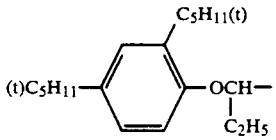 | H | Cl |

The examples of the cyan coupler also include the 2,5-diacylaminophenol-based cyan couplers described in Japanese Patent 0.P.I. Publication Nos. 178962/1987, 225155/1985, 222853/1985 and 185335/1984, which can be synthesized in accordance with the methods described therein.

It is preferable that the cyan coupler of the present invention be used in a red sensitive silver halide emulsion layer.

The amount of cyan coupler of the present invention is preferably $2\times10^{-3}$ to $8\times10^{-1}$ mol per mol silver halide, especially preferably $3\times10^{-2}$ to $5\times10^{-1}$ mol.

In the present invention, the cyan coupler of Formula III is contained at a ratio of over 50 mol % of the total cyan coupler content. The cyan coupler of Formula III is preferably used at a ratio of over 70 mol %, more preferably over 80 mol %, and ideally over 90 mol % of the total cyan coupler content.

The compound represented by Formula II for use in combination with the cyan coupler of the present invention (hereinafter referred to as the noncoloring compound of the present invention) is described below.

The alkyl group represented by $R_3$ or $R_4$ in Formula II has 1 to 32 carbon atoms; the alkenyl group and alkynyl group have 2 to 32 carbon atoms; the cycloalkyl group and cycloalkenyl group have 3 to 12 carbon atoms. The alkyl group, alkenyl group and alkynyl group may be normal or branched. These groups may have a substituent.

The aryl group represented by $R_3$ or $R_4$ is preferably a 5- to 7-membered group, which may be condensed and which may have a substituent.

The alkoxy group represented by $R_3$ or $R_4$ may contain a substituent; the examples include 2-ethoxyethoxy group, pentadecyloxy group, 2-dodexylocyethoxy group and phenetyloxyethoxy group.

The aryloxy group is preferably a phenyloxy group. Its aryl nucleus may be substituted. The examples include phenoxy group, p-t-butylphenoxy group and m-phentadecylphenoxy group.

The heterocyclic oxy group preferably has a 5- to 7-membered ring, which may have a substituent. The examples include 3,4,5,6-tetrahydropyranyl-2-oxy group and 1-phenyltetrazol-5-oxy group.

The alkylamino group and arylamino group may have a substituent. The examples include diethylamino group, anilino group, p-chloranilino group, dodecylamino group and 2-methyl-4-cyanoanilino group.

In Formula II, at least one of the groups for $R_3$ and $R_4$ is an electron-attracting group. The electron-attracting group is defined as an atomic group that attracts electrons from the counterpart group by resonance effect or inductive effect. In general, it is a group whose Hammett $\delta\eta$ value has a positive value.

The electron-attracting group is preferably chosen from —CN, $—COR_8$, $—CSR_9$, $—SO_2R_{10}$ and $—SO_2R_{11}$. $R_8$ through $R_{11}$ are monovalent organic groups, e.g. alkyl group, cycloalkyl group, alkenyl group, cycloalkenyl group, alkynyl group, aryl group, heterocyclic group, alkoxy group, aryloxy group, heterocyclic oxy group, alkylamino group and arylamino group.

$R_3$ and $R_4$ both may be electron-attracting groups.

Of the noncoloring compounds of the present invention, the compound represented by Formula IV is preferable.

$$R_{12}—NHSO_2—R_{13} \qquad \text{IV}$$

wherein $R_{12}$ and $R_{13}$ independently represent a hydrogen atom, alkyl group, cycloalkyl group, alkenyl group, cycloalkenyl group, alkynyl group, aryl group, heterocyclic group, alkoxy group, aryloxy group, heterocyclic oxy group or

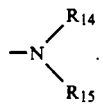

$R_{14}$ and $R_{15}$ independently represent a hydrogen atom, alkyl group or aryl group, $R_{12}$ and $R_{13}$ may be identical or not.

The examples of the alkyl group, cycloalkyl group, alkenyl group, cycloalkenyl group, alkynyl group, aryl group, heterocyclic group, alkoxy group, aryloxy group, heterocyclic oxy group and

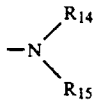

represented by $R_{12}$ or $R_{13}$ are the same as those of the alkyl group, cycloalkyl group, alkenyl group, cycloalkenyl group, alkynyl group, aryl group, heterocyclic group, alkoxy group, aryloxy group, heterocyclic oxy group, alkylamino group and arylamino group represented by $R_2$, $R_4$ and $R_8$ through $R_{11}$ in Formula II.

Of the noncoloring compounds of the present invention, the compound represented by Formula V is especially preferable.

$$R_{16}—NHSO_2—R_{17} \quad V$$

wherein $R_{16}$ and $R_{17}$ independently represent an alkyl group or aryl group, which may be substituted. It is preferable that at least one of $R_{16}$ and $R_{17}$ be an aryl group. It is more preferable that $R_{16}$ and $R_{17}$ are both an aryl group. The preferable aryl group is phenyl group. When $R_{16}$ is a phenyl group, it is especially preferable that the substituent at the para-position in the sulfonamide group have a $\delta\eta$ value of not less than $-0.4$.

The alkyl group and aryl group represented by $R_{16}$ or $R_{17}$ have the same definitions as those of the alkyl group and aryl group represented by $R_{12}$ or $R_{13}$ in Formula IV.

The noncoloring compound of the present invention may form a dimer or higher polymer for $R_3$ or $R_4$, and $R_3$ and $R_4$ may link together to form a 5- or 6-membered ring.

It is preferable that the total number of carbon atoms in the noncoloring compound of the present invention be 8 or more, especially preferably 12 or more.

Examples of the noncoloring compounds represented by Formulae IV and V are given below.

| | $R_{12}—NHSO_2—R_{13}$ | |
|---|---|---|
| NO | $R_{12}$ | $R_{13}$ |
| A-1 | 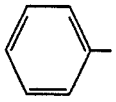 | 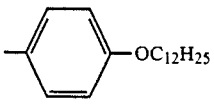 |
| A-2 | 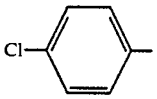 | 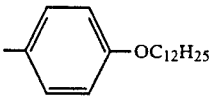 |
| A-3 | 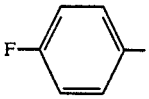 | 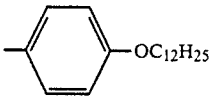 |
| A-4 | 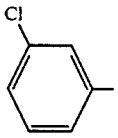 | 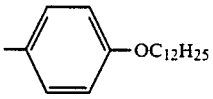 |
| A-5 | 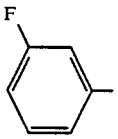 | 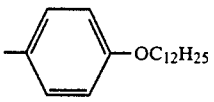 |
| A-6 | 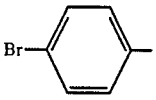 | 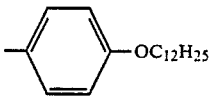 |
| A-7 | 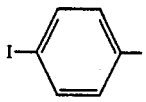 | 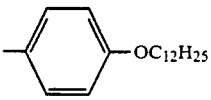 |
| A-8 | 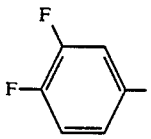 | 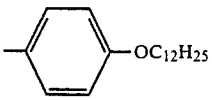 |

-continued
| | $R_{12}$—$NHSO_2$—$R_{13}$ |
|---|---|
| A-9 | 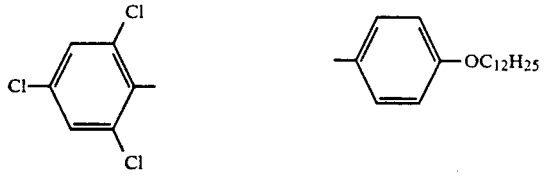 |
| A-10 | 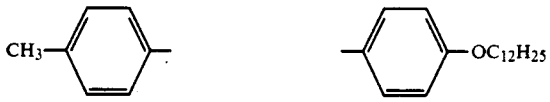 |
| A-11 | 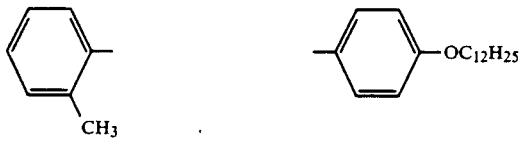 |
| A-12 | 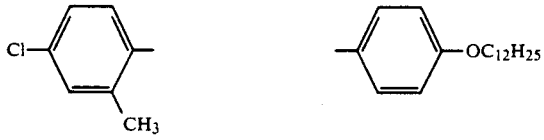 |
| A-13 | 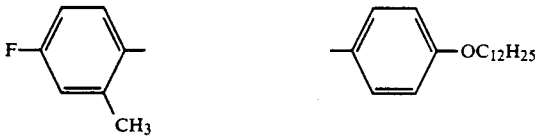 |
| A-14 | 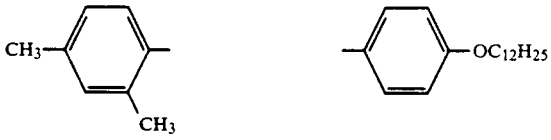 |
| A-15 | 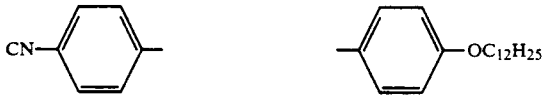 |
| A-16 | 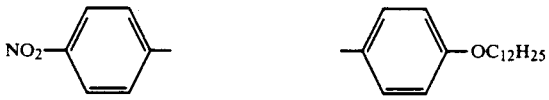 |
| A-17 | 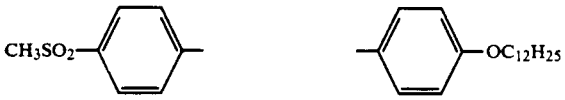 |
| A-18 | 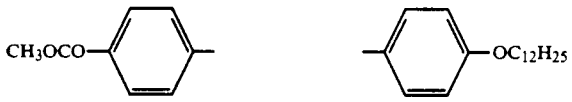 |
| A-19 | 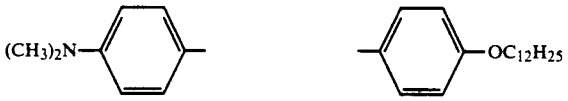 |

-continued
| | $R_{12}$—$NHSO_2$—$R_{13}$ |
|---|---|
| A-20 | 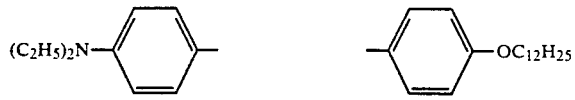 |
| A-21 | 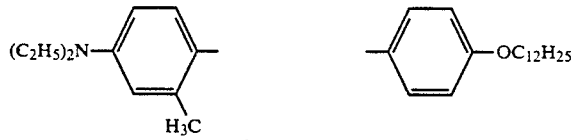 |
| A-22 | 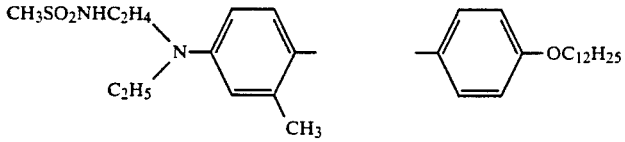 |
| A-23 | 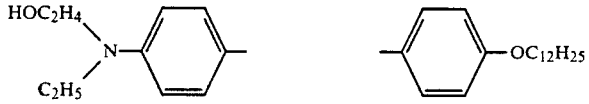 |
| A-24 | 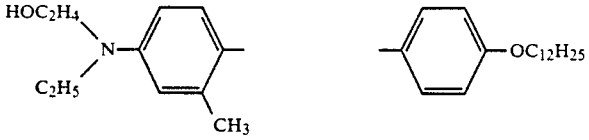 |
| A-25 | 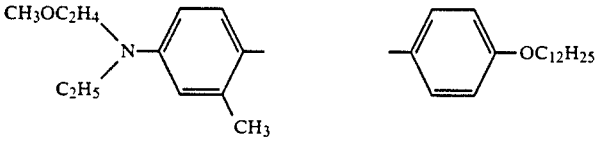 |
| A-26 | 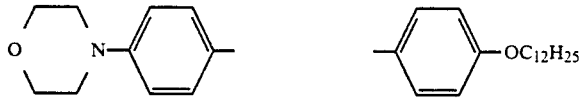 |
| A-27 | 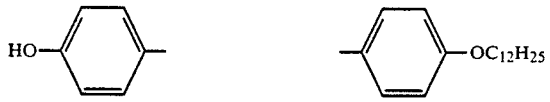 |
| A-28 | 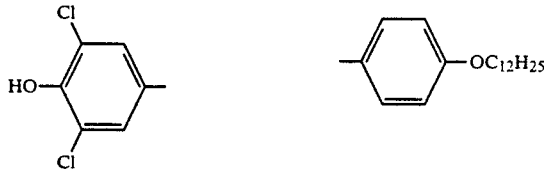 |
| A-29 | 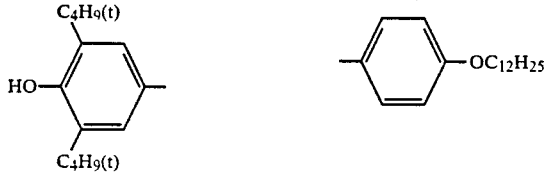 |
| A-30 | 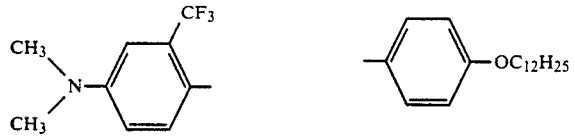 |

-continued
| | $R_{12}$—$NHSO_2$—$R_{13}$ | |
|---|---|---|
| A-31 | 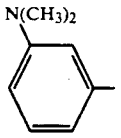 | 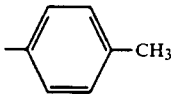 |
| A-32 | 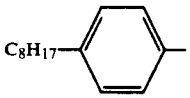 | 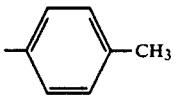 |
| A-33 | 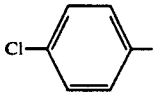 | 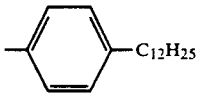 |
| A-34 | 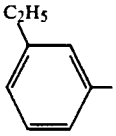 | 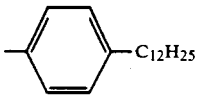 |
| A-35 | 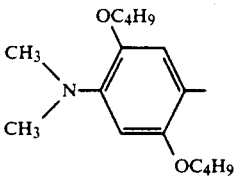 | 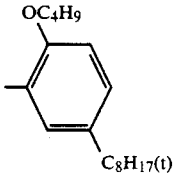 |
| A-36 | 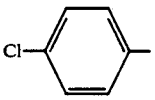 | 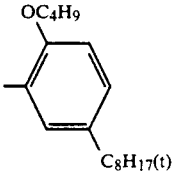 |
| A-37 | 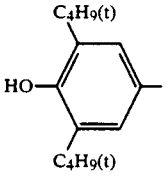 | 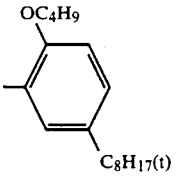 |
| A-38 | 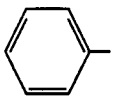 | 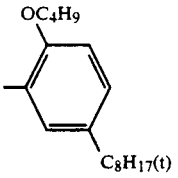 |
| A-39 | 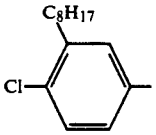 | 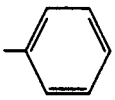 |
| A-40 | 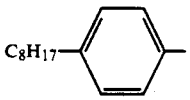 | 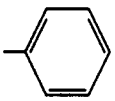 |
| A-41 | 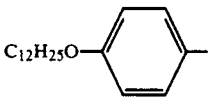 | 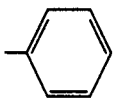 |

-continued
| | $R_{12}$—$NHSO_2$—$R_{13}$ | |
|---|---|---|
| A-42 | 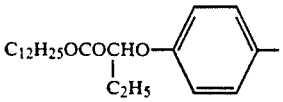 | 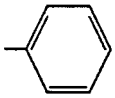 |
| A-43 | 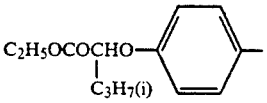 | 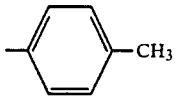 |
| A-44 | 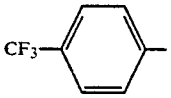 | 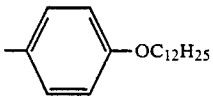 |
| A-45 | 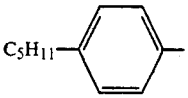 | 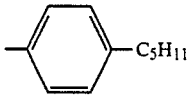 |
| A-46 | 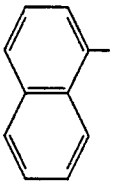 | 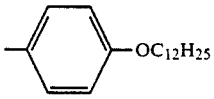 |
| A-47 | 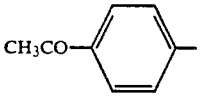 | 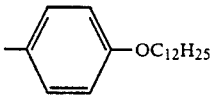 |
| A-48 | 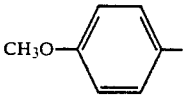 | 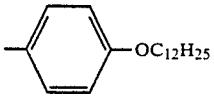 |
| A-49 | 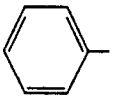 | $-C_{16}H_{33}$ |
| A-50 | 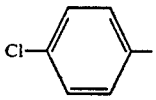 | $-C_{16}H_{33}$ |
| A-51 | 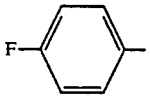 | $-C_{16}H_{33}$ |
| A-52 | 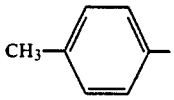 | $-C_{16}H_{33}$ |
| A-53 | 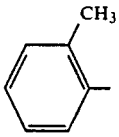 | $-C_{16}H_{33}$ |

-continued

| | $R_{12}$—$NHSO_2$—$R_{13}$ | |
|---|---|---|
| A-54 | $CH_3OCO$— | —$C_{16}H_{33}$ |
| A-55 | $CH_3SO_2$— | —$C_8H_{17}$ |
| A-56 | | —$CH_2CH(OH)$— |
| A-57 | $C_8H_{17}$— | —$C_3H_7$(i) |
| A-58 | $C_8H_{17}$— | |
| A-59 | $C_4H_9CH(C_2H_5)CH_2$— | |
| A-60 | $CH_3$— | —$OC_{12}H_{25}$ |
| A-61 | $Cl(CH_2)_2$— | —$OC_{12}H_{25}$ |
| A-62 | $CF_3CH_2$— | $OC_4H_9$, $C_8H_{17}$(t) |
| A-63 | —$CH_2$— | $OC_4H_9$, $C_8H_{17}$(t) |
| A-64 | $C_8H_{17}$— | —$CH_3$ |
| A-65 | $C_{12}H_{25}$— | —Cl |

-continued
| | $R_{12}$—$NHSO_2$—$R_{13}$ |
|---|---|
| A-66 | 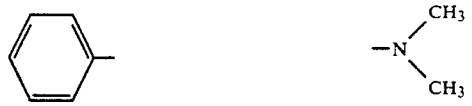 |
| A-67 | 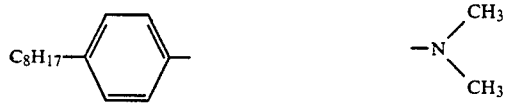 |
| A-68 | 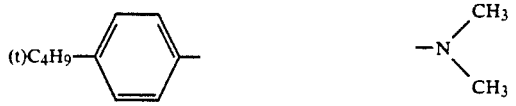 |
| A-69 | 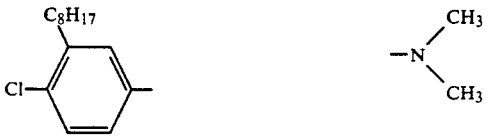 |
| A-70 | 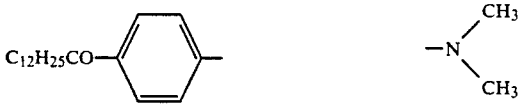 |
| A-71 | 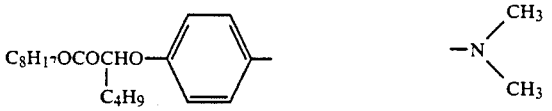 |
| A-72 | 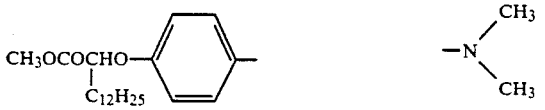 |
| A-73 | 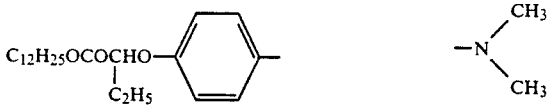 |
| A-74 | 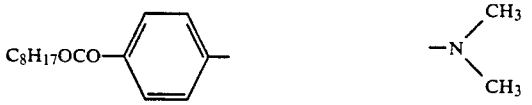 |
| A-75 | 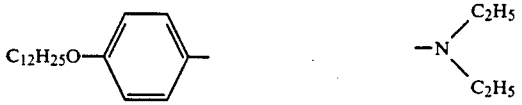 |
| A-76 | 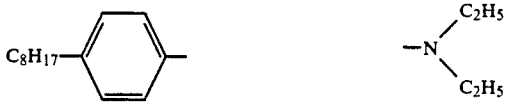 |
| A-77 | 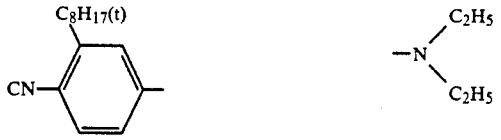 |
| A-78 | 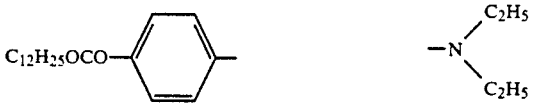 |

-continued
| | $R_{12}$—$NHSO_2$—$R_{13}$ | |
|---|---|---|
| A-79 | 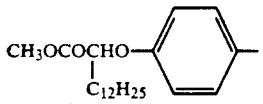 | 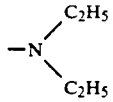 |
| A-80 | 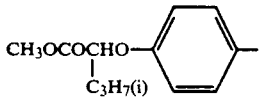 | 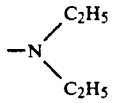 |
| A-81 | 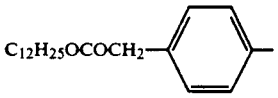 | 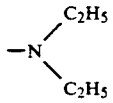 |
| A-82 | 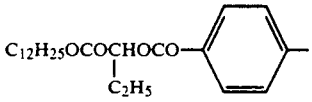 | 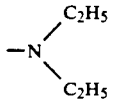 |
| A-83 | 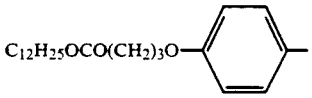 | 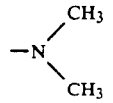 |
| A-84 | 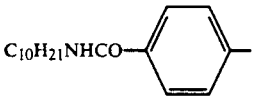 | 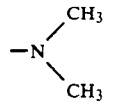 |
| A-85 | $C_8H_{17}$— | 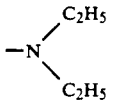 |
| A-86 | 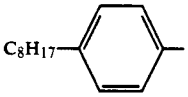 | 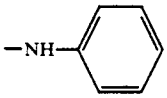 |
| A-87 | $C_8H_{17}$— | —$C(CH_3)_3$ |
| A-88 | $CCl_3CH_2$— | —$C_{16}H_{33}$ |
| A-89 | 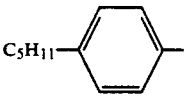 | 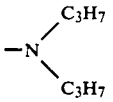 |
| A-90 | H— | 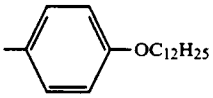 |
| A-91 | 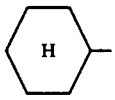 | 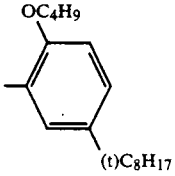 |
| A-92 | $CF_3CH{=}CH$— | 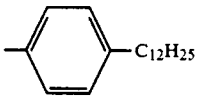 |

-continued
| | $R_{12}$—$NHSO_2$—$R_{13}$ | |
|---|---|---|
| A-93 | 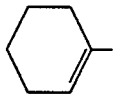 | 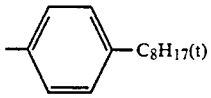 |
| A-94 | $HOCH_2CH_2C{\equiv}C$— | 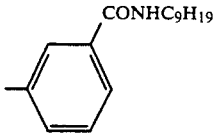 |
| A-95 | 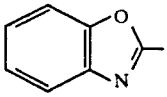 | —$C_{18}H_{37}$ |
| A-96 | 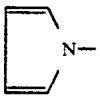 | 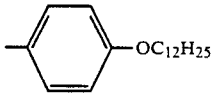 |
| A-97 | $C_4H_9CO$— | 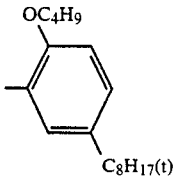 |
| A-98 | $C_{10}H_{21}NHCO$— | 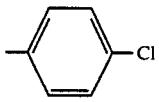 |
| A-99 | 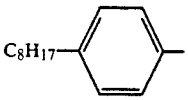 | —$OC_2H_5$ |
| A-100 | 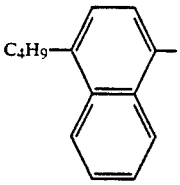 | 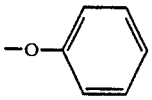 |
| A-101 | 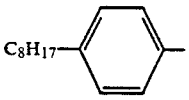 | 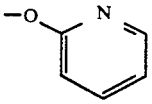 |
| A-102 | 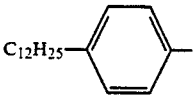 | —$NH_2$ |
| A-103 | 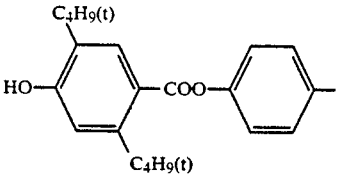 | 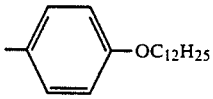 |

-continued
| | $R_{12}$—$NHSO_2$—$R_{13}$ |
|---|---|
| A-104 | 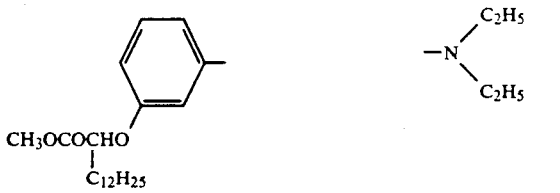 |
| A-105 | 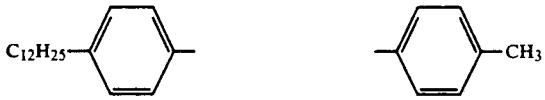 |
| A-106 | 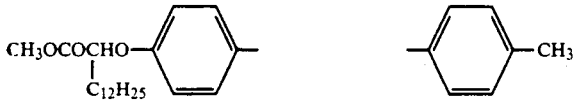 |
| A-107 | 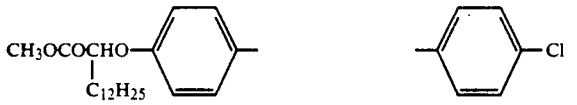 |
| A-108 | 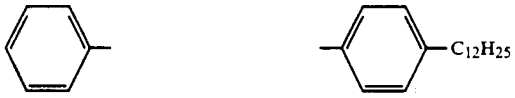 |
| A-109 | 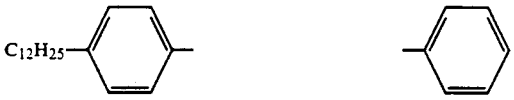 |
| A-110 | 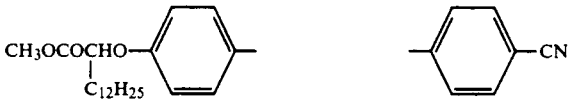 |
| A-111 | 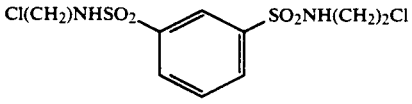 |
| A-112 | 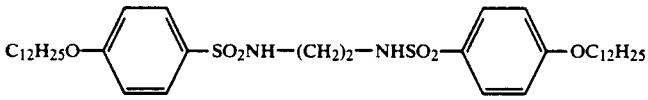 |
| A-113 | 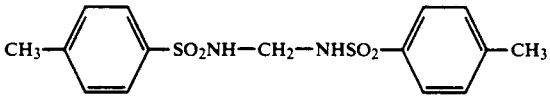 |
| A-114 | 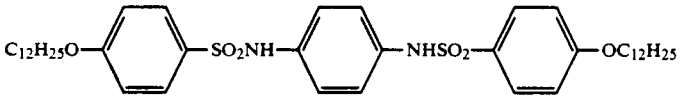 |
| A-115 | 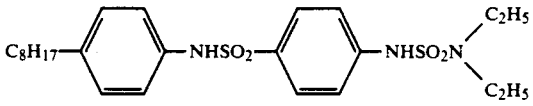 |

-continued
| $R_{12}—NHSO_2—R_{13}$ |
|---|
| A-116 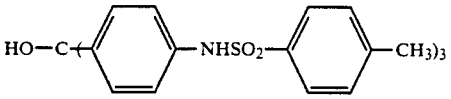 |
| A-117 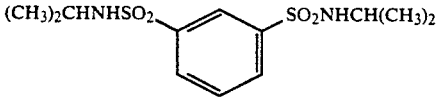 |
| A-118 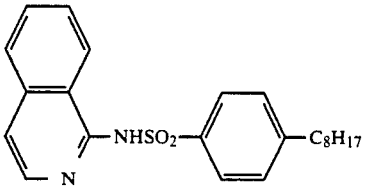 |
| A-119 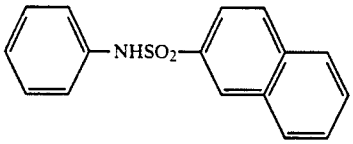 |
| A-120 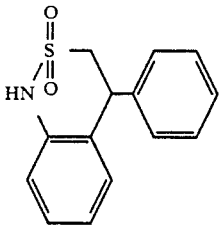 |
| A-121 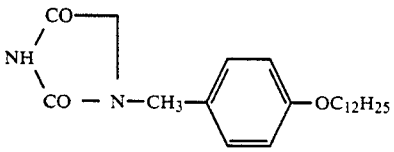 |
| A-122 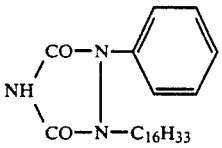 |
| A-123 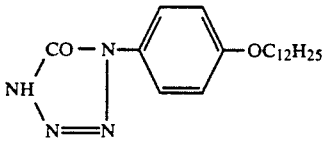 |
| A-124 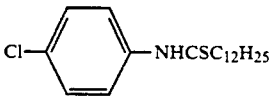 |
| A-125 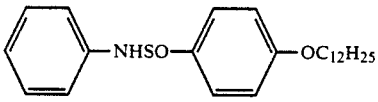 |

-continued

| $R_{12}—NHSO_2—R_{13}$ |
|---|
| A-126 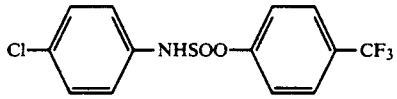 |
| A-127 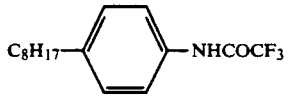 |
| A-128 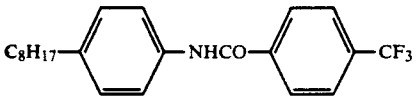 |

The noncoloring compound of the present invention can be synthesized by a known method such as the method described in Japanese Patent O.P.I. Publication No. 178258/1987.

The amount of noncoloring compound of the present invention is preferably 5 to 500 mol %, more preferably 10 to 200 mol %, relative to the 2,5-diacylaminophenol cyan coupler of the present invention.

The noncoloring compound of Formula VI used in combination with the diacylamino cyan coupler of the present invention is described below.

VI

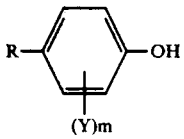

wherein R represents an alkyl group, alkoxycarbonyl group, arylsulfonylamino group or alkylsulfonylamino group.

The alkyl group represented by R is preferably a normal or branched alkyl group having 1 to 32 carbon atoms, which may have a substituent. The examples of such alkyl groups are normal and branched butyl group, hexyl group, decyl group, docecyl group and octadecyl group. It is especially preferable that the alkyl group represented by R have 4 to 20 carbon atoms, still more preferably 5 to 9 carbon atoms.

The alkoxycarbonyl group represented by R preferably has 2 to 20 carbon atoms. The alkyl moiety of such alkoxycarbonyl groups may be normal or branched. These alkoxycarbonyl groups include those having a substituent.

The examples of such alkoxycarbonyl groups include methoxycarbonyl group, ethoxycarbonyl group, hexyloxycarbonyl group, octyloxycarbonyl group, undecyloxycarbonyl group and octadecyloxycarbonyl group.

It is especially preferable that the alkoxycarbonyl group represented by R have 2 to 14 carbon atoms, more preferably 5 to 13 carbon atoms.

The examples of the arylsulfonylamino group represented by R include benzenesulfonylamino group and naphthalenesulfonylamino group, which may have a substituent.

The examples of such arylsulfonylamino groups include p-toluenesulfonylamino group, p-dodecylbenzenesulfonylamino group, p-dodecyloxybenzenesulfonylamino group, p-chlorobenzenesulfonylamino group, p-octylbenzenesulfonylamino group, 1-naphthalenesulfonylamino group and 4-dodecyloxynaphthalenesulfonylamino group.

The alkylsulfonylamino group represented by R preferably has a normal or branched alkyl group having 1 to 32 carbon atoms, which may have a substituent. The examples of such alkylsulfonylamino groups include methylsulfonylamino group, ethylsulfonylamino group, normal and branched butylsulfonylamino group, dodecylsulfonylamino group and hexadecylsulfonylamino group.

It is especially preferable that the halogen atom represented by Y in Formula VI be a chlorine atom.

The group represented by Y is not subject to particular limitation, as long as it is substitutable by a hydrogen atom on the benzene ring. The examples of such groups include alkyl groups, cycloalyl groups, alkenyl groups, cycloalkenyl groups, alkynyl groups, aryl groups, heterocyclic groups, alkoxy groups, aryloxy groups,

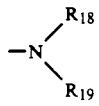

($R_{18}$ and $R_{19}$ independently represent an alkyl group or aryl group), cyano group, acyl group, alkoxycarbonyl group, carbamoyl group, sulfamoyl group, nitro group, carboxyl group, sulfo groups, alkylthio group, acylamino group, sulfonamido group, arylthio group and hydroxy group.

Examples of the noncoloring compound of the present invention are given below.

Example compounds B (B-1)

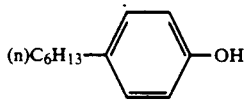

(B-2)

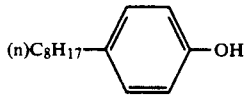

(B-3)

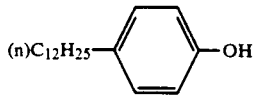

-continued
Example compounds B
(B-4)
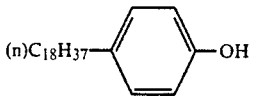
(B-5)
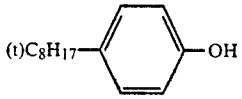
(B-6)
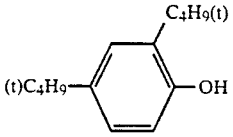
(B-7)
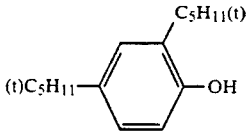
(B-8)
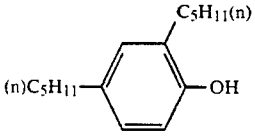
(B-9)
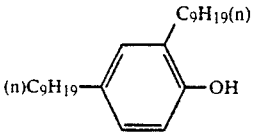
(B-10)
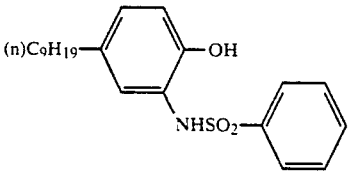
(B-11)
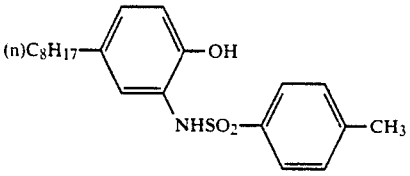
(B-12)
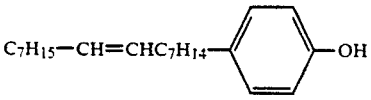
(B-13)
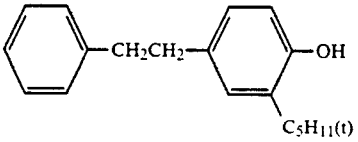
(B-14)
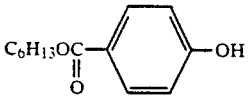
-continued
Example compounds B
(B-15)
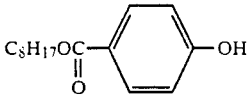
(B-16)
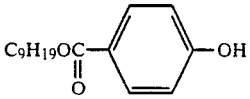
(B-17)
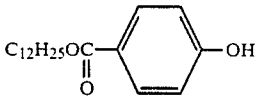
(B-18)
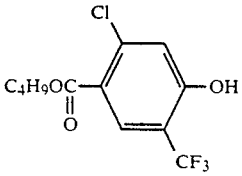
(B-19)
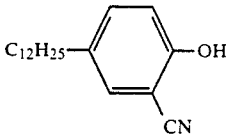
(B-20)
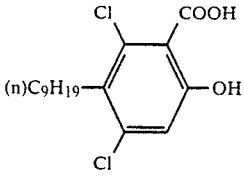
(B-21)
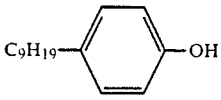
(B-22)
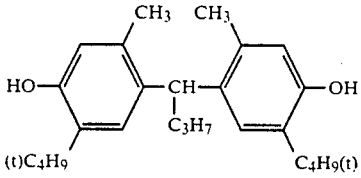
(B-23)
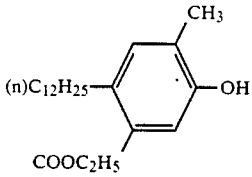
(B-24)
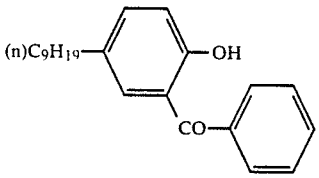

-continued
Example compounds B
(B-25)
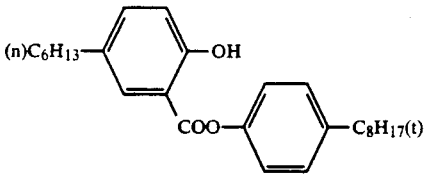
(B-26)
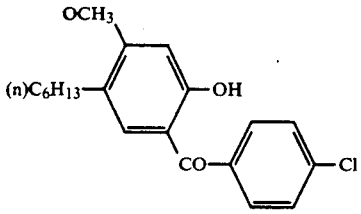
(B-27)
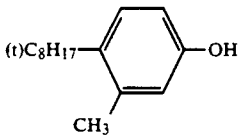
(B-28)
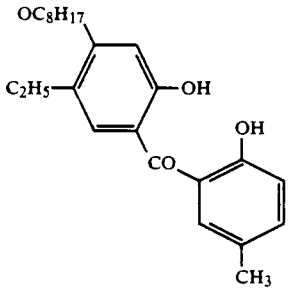
(B-29)
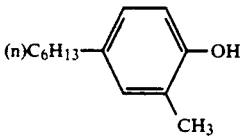
(B-30)
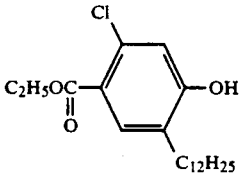
(B-31)
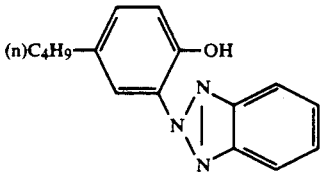
(B-32)
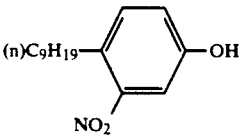
-continued
Example compounds B
(B-33)
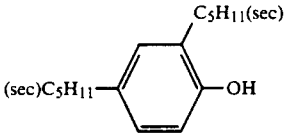
(B-34)
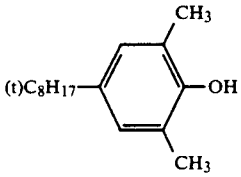
(B-35)
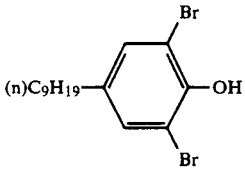
(B-36)
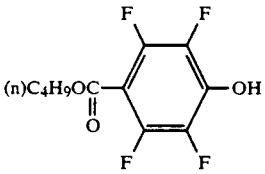
(B-37)
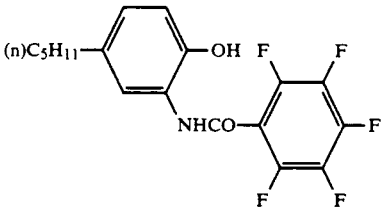
(B-38)
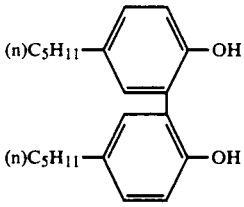
(B-39)
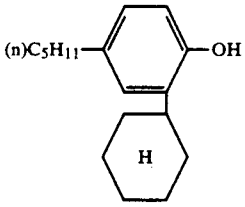
(B-40)
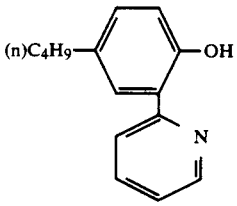

-continued

Example compounds B (B-41)

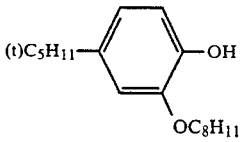

(B-42)

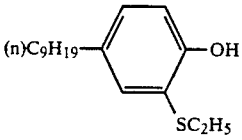

(B-43)

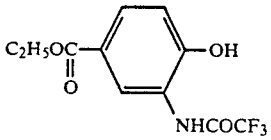

(B-44)

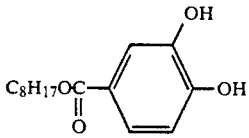

(B-45)

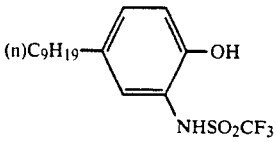

(B-46)

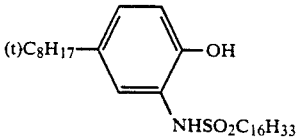

(B-47)

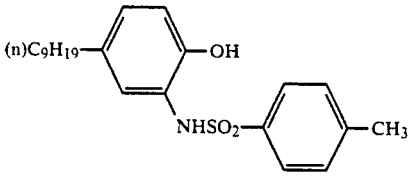

(B-48)

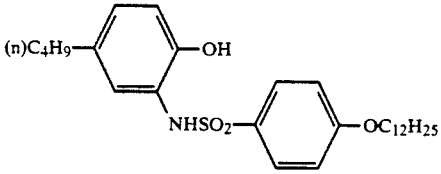

(B-49)

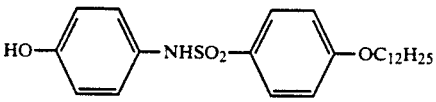

(B-50)

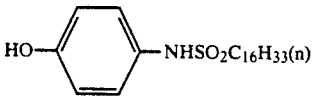

-continued

Example compounds B (B-51)

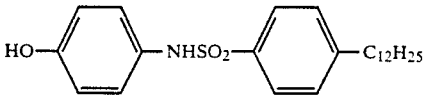

(B-52)

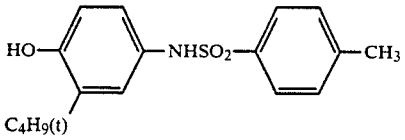

(B-53)

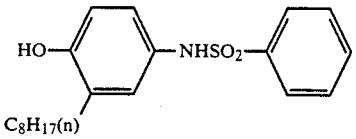

(B-54)

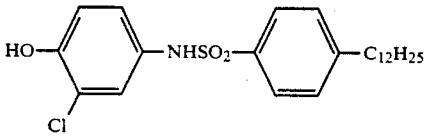

(B-55)

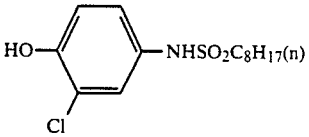

(B-56)

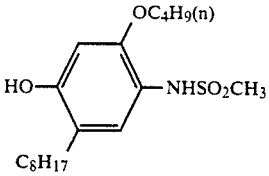

(B-57)

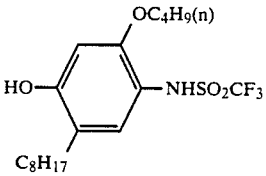

The noncoloring compound of the present invention can be synthesized by a known method such as the method described in U.S. Pat. No. 2,835,579. Many commercial products of the noncoloring compound are available, including Compounds B-3, B-5, B-7, B-16 and B-21.

The amount of the noncoloring compound of the present invention is preferably 5 to 500 mol %, more preferably 10 to 300 mol %, relative to the cyan coupler represented by Formula III.

The noncoloring compound of the present invention can be used singly or in combination with one or more other types.

The preferable compound used in combination with the cyan coupler represented by Formula III of the present invention is represented by Formula II.

It is preferable to use the cyan coupler of the present invention and the noncoloring compound of the present invention in the same layer. It is ideal that the cyan coupler of the present invention and the noncoloring compound of the present invention are simultaneously dissolved in an appropriate organic solvent having a boiling point of over 150° C. or low-boiling-point or water-soluble organic solvent and emulsified and dispersed in a hydrophilic binder such as an aqueous gelatin solution in the presence of a surfactant and then added to the desired hydrophilic colloid layer.

In the present invention, a yellow dye forming coupler and a magnenta dye forming coupler are contained respectively in the yellow coloring layer and magenta coloring layer, while the cyan coupler is contained in silver halide emulsion layer.

As the yellow dye forming coupler, a benzoylacetanilide type coupler or pivaloylacetanilide type coupler is used. These couplers may be two-equivalent yellow dye forming couplers whose carbon atom at the coupling position is substituted by a substituent capable of splitting off during coupling reaction (what is called split-off group).

The examples of the magenta dye forming coupler include 5-pyrazolone compounds, pyrazolotriazole compounds, pyrazolinobenzimidazole compounds and indazolone compounds. Two-equivalent magenta dye forming couplers having a split-off group are preferable. It is especially preferable to use a pyrazolotriazole coupler.

The present invention permits preparation of color images for proof (color proof) comprising color-separated black-and-white dot images in more than one sheet for use in the color processing and printing processes.

The method of image formation of the present invention is very unique in that the obtained images are very similar to printed cyan images in color tone over a wide range of dot size of from small dots to large dots when dot images with varied dot area are printed as cyan images.

The silver halide emulsion used in the light sensitive layer of the silver halide color photographic light sensitive material for the present invention is described below.

For a silver halide emulsion for the present invention, silver halides used for ordinary silver halide emulsion such as silver bromide, silver iodobromide, silver iodochloride, silver chlorobromide and silver chloride can be used as appropriate for the desired images.

The silver halide grain composition may be uniform from inside to outside, and may be different between inside and outside. When the composition differs between inside and outside, the compositional change may be continuous or incontinuous.

Although there is no particular limitation of the grain size of silver halide, it is preferable, in view of quick processing property, sensitivity and other photographic properties, that the grain size be 0.2 to 1.6 μm, more preferably 0.25 to 1.2 μm.

The grain size distribution of silver halide may be polydispersible or monodispersible. It is preferable that the silver halide grains be monodispersible silver halide grains with a coefficient of variance of not more than 0.22, more preferably not more than 0.15 in the grain size distribution thereof. Here, the coefficient of variance, a coefficient representing the width of grain size distribution, is defined by the following equation.

$$\text{Coefficient of variance } (S/r) = \frac{\text{Standard deviation of grain size distribution}}{\text{Average grain size}}$$

Here, grain size means the diameter of silver halide grains when they are spherical, or the diameter of circle images converted from projected images of silver halide grains with the equal area when the grains are not spherical.

The silver halide color photographic light sensitive material for the present invention may have various photographic structural layers such as filter layers, interlayers, protective layers, subbing layers, backing layers and anti-halation layers, as well as emulsion layers formed on support to bear images.

The silver halide color photographic light sensitive material for the present invention has at least three light sensitive layers with different spectral sensitivities; it is preferable that the spectral sensitivities be provided so that color mixing does not occur easily when exposure is conducted with light having more than one different spectral distribution; for example, it is preferable that the first layer be a blue-sensitive silver halide emulsion layer, another layer be a green-sensitive silver halide emulsion layer made to have a maximum sensitivity to green light by means of a sensitizing dye, and the other one layer be a red-sensitive silver halide emulsion layer made to have a maximum sensitivity to red light by means of a sensitizing dye.

Some examples of preferable layer composition, including preferable combinations of spectral sensitivity and image hue, for these three layers are given below.

| λ max of spectral sensitivity of the layer containing yellow coupler | λ max of spectral sensitivity of the layer containing magenta coupler | λ max of spectral sensitivity of the layer containing cyan coupler |
|---|---|---|
| 470 nm | 550 nm | 650 nm |
| 470 nm | 550 nm | 700 nm |
| 450 nm | 550 nm | 700 nm |
| 470 nm | 590 nm | 700 nm |
| 550 nm | 470 nm | 660 nm |
| 660 nm | 470 nm | 550 nm |
| 470 nm | 650 nm | 800 nm |

The light sensitive material for the present invention is exposable using electromagentic waves having spectral range in which the componental emulsion layers have sensitivities.

Silver halide color photographic light sensitive materials having blue-sensitive, green-sensitive and red-sensitive layers as in ordinary color paper can be exposed using color separation filters, e.g. Wratten Nos. 25, 29, 58, 61, 47B, 98 and 99.

EXAMPLES

The present invention is hereinafter described by means of some working examples.

EXAMPLE 1

An aqueous solution of silver halide and an aqueous solution of potassium bromide in a molar ratio of 1 to 1 were simultaneously added to an aqueous solution of gelatin at 50° C. by the double jet method over a period of about 50 minutes to yield an emulsion comprising cubic silver halide grains of 0.3 μm in average grain size. To this emulsion were added an aqueous solution of silver nitride and a mixed aqueous solution of sodium chloride and potassium bromide (molar ratio 1 to 1) at a time to yield a cubic core/shell type emulsion EM-1, comprising grains formed with silver bromide core and silver chlorobromide shell of 0.45 μm in average grain size.

After spectral sensitization by addition of sensitizing dyes RD-1, RD-2, GD-1 and BD-1, respectively suitable to light sensitive layers of the above emulsion, layers of compositions shown in Table 1 were coated to yield a silver halide color photographic material for a sample.

TABLE 1

| Layer | Composition | Content (mg/dm$^2$) |
|---|---|---|
| 10th layer: UV absorption layer | Gelatin | 7.8 |
| | UV absorber UV-1 | 0.65 |
| | UV absorber UV-2 | 1.95 |
| | Solvent SO-3 | 1.0 |
| | Colloidal silica | 0.30 |
| 9th layer: Blue-sensitive layer | Gelatin | 14.3 |
| | Silver chlorobromide emulsion EM-1 [Sensitizing dye BD-1, average grain size 0.45 μm] | 5.0* (300 mg/mol AgX) |
| | Yellow coupler YC-1 | 8.2 |
| | Anti-stain agent AS-2 | 0.25 |
| | Solvent SO-1 | 8.2 |
| | Restrainers ST-1, ST-2, ST-4 | (30 mg 30 mg 30 mg 600 mg/mol AgX) |
| 8th layer: Interlayer | Gelatin | 5.4 |
| | Color mixing preventive agent AS-1 | 0.55 |
| | Solvent SO-2 | 0.72 |
| 7th layer: Yellow Colloidal layer | Gelatin | 4.2 |
| | Yellow colloidal silver | 1.02 |
| | Color mixing preventive agent AS-1 | 0.40 |
| | Solvent SO-2 | 0.49 |
| | Polyvinylpyrrolidone PVP | 0.47 |
| 6th layer: Interlayer | Gelatin | 5.4 |
| | Color mixing preventive agent AS-1 | 0.55 |
| | Solvent SO-2 | 0.72 |
| 5th layer: Green-sensitive layer | Gelatin | 13.0 |
| | Silver chlorobromide emulsion EM-1 | 3.0* |
| | Sensitizing dye GD-1 | 150 mg/mol AgX |
| | Magenta coupler MC-1 | 2.4 |
| | Anti-stain agent AS-2 | 0.19 |
| | Solvent SO-1 | 3.1 |
| | Anti-irradiation dye AI-1 | 0.35 |
| | Restrainers ST-1, ST-2, ST-3, ST-4 | (30 mg 30 mg 30 mg 600 mg/mol AgX) |
| 4th layer: Interlayer | Gelatin | 7.5 |
| | Color mixing preventive agent AS-1 | 0.55 |
| | Solvent SO-2 | 0.72 |
| 3rd layer: Red-sensitive layer | Gelatin | 13.8 |
| | Silver chlorobromide emulsion EM-1 | 4.0* |
| | Sensitizing dyes RD-1, RD-2 | (140 mg/mol AgX) |
| | Cyan coupler (as shown in Table 2) | |
| | Compound of Formula II (as shown in Table 2) | |
| | Anti-stain agent AS-2 | 0.15 |
| | Anti-irradiation dye AI-2 | 0.25 |
| | Restrainers ST-1, ST-2, ST-3, ST-4 | (30 mg 30 mg 30 mg 600 mg/mol AgX) |
| 2nd layer: Interlayer | Gelatin | 5.4 |
| | Color mixing preventive agent AS-1 | 0.55 |
| | Solvent SO-2 | 0.72 |
| 1st layer: Anti-halation layer | Gelatin | 6.0 |
| | Black colloidal silver | 1.0 |

*Silver halide content was calculated as silver content.

RD-1

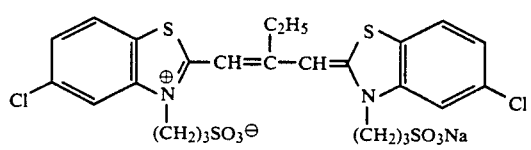

RD-2

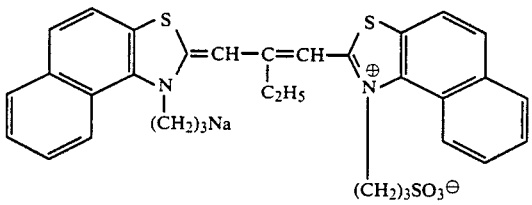

TABLE 1-continued
| Layer | Composition | Content (mg/dm$^2$) |
|---|---|---|
| GD-1 | 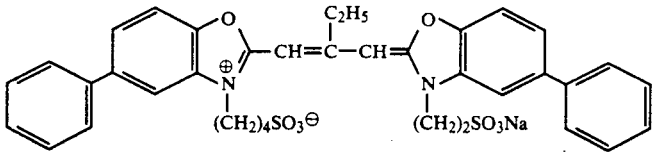 | |
| BD-1 | 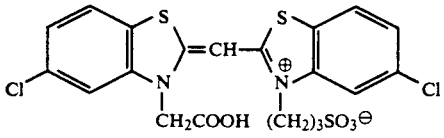 | |
| YC-1 | 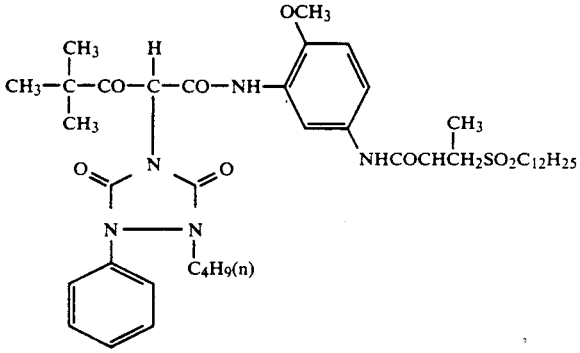 | |
| SO-1 | 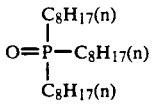 | |
| SO-2 | 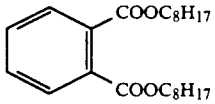 | |
| AS-1 | 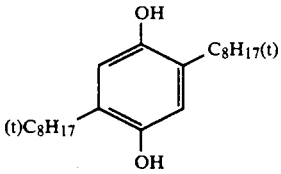 | |
| AS-2 | 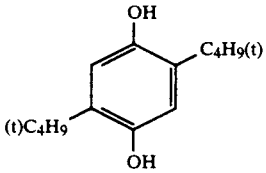 | |
| AI-1 | 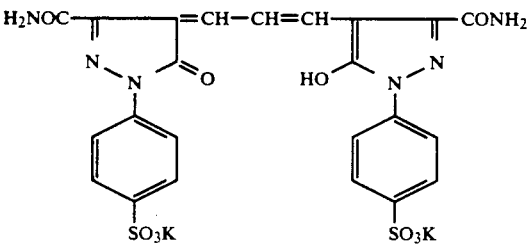 | |

TABLE 1-continued
| Layer | Composition | Content (mg/dm$^2$) |
|---|---|---|
| AI-2 | 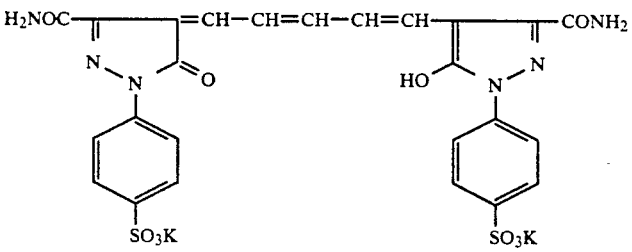 | |
| CC-1 | 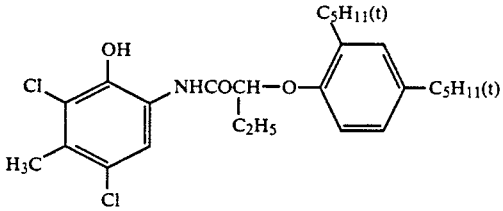 | |
| MC-1 | 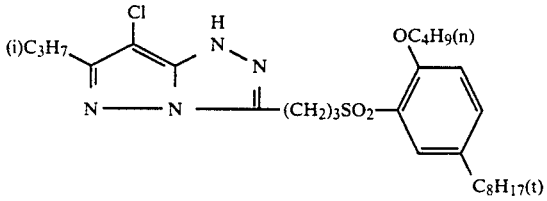 | |
| ST-1 | 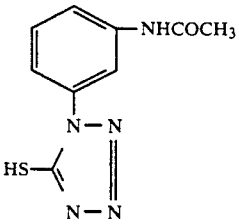 | |
| ST-2 | 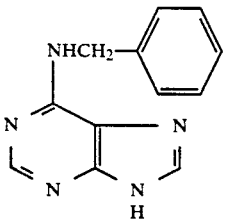 | |
| ST-3 | 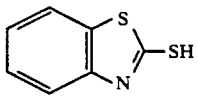 | |
| ST-4 | 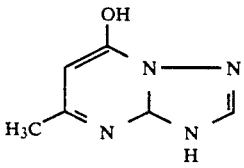 | |
| HA-1 | 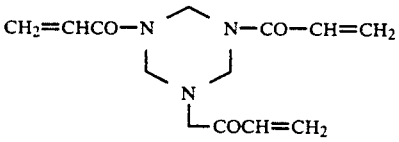 | |

TABLE 1-continued

| Layer | Composition | Content (mg/dm$^2$) |
|---|---|---|
| HA-2 | 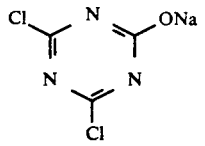 | |
| UV-1 | 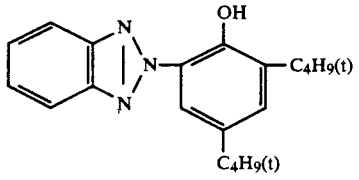 | |
| UV-2 | 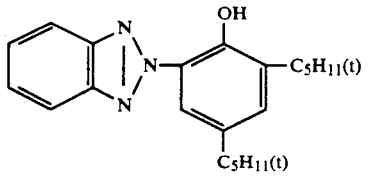 | |
| SA-1 | 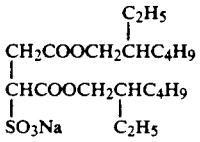 | |
| SA-2 | 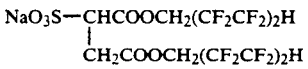 | |

The 1st through 10th layers of the compositions shown in Table 1 were coated on a support laminated with polyethylene on both faces to yield color printing paper. Coating aids SA-1 and SA-2 and hardeners HA-1 and HA-2 were used.

Internal latent image type direct positive silver halide color photographic light sensitive material sample Nos. 1 through 15 prepared as above were passed through a red filter (Wratten No. 26) and an ND filter and exposed to white light, while adjusting the density of the ND filter, for 0.5 second with a minimum exposure amount so that the red light density was minimized after the following developing process. This set of exposure conditions is called conditions A.

After exposure under conditions A, each of sample Nos. 1 through 15 was passed through a green filter (Wratten No. 99) and an ND filter and exposed to white light, while adjusting the density of the ND filter, for 0.5 second with a minimum exposure amount so that the green light density was minimized after the following developing process. This set of exposure conditions is called conditions B.

After exposure under exposure conditions A and then exposure conditions B, each of sample Nos. 1 through 15 was passed through a blue filter (Wratten No. 98) and an ND filter and exposed to white light, while adjusting the density of the ND filter, for 0.5 second with a minimum exposure amount so that the blue light density was minimized after the following developing process. This set of conditions (using a blue filter) is called conditions C.

After exposure under conditions B and then conditions C, each of sample Nos. 1 through 15 was passed through a red filter and an ND filter and exposed to white light, while adjusting the density of the ND filter, so that the absorbance at λ max of the sample's spectral absorption became 1.3±0.02 after the following developing process.

These exposed samples were processed by the following processing procedures.

| Processing procedures (processing temperature and time) | | |
|---|---|---|
| (1) Color development | 38° C. | 8 sec. |
| (2) Fogging exposure | — | 1 lux, 10 sec. |
| (3) Color development | 38° C. | 2 min. |
| (4) Bleach fixing | 35° C. | 60 sec. |
| (5) Stabilization | 25 to 30° C. | 1 min. 30 sec. |
| (6) Drying | 75 to 80° C. | 1 min. |

Composition of processing solutions

| Color developer | |
|---|---|
| Benzyl alcohol | 15 ml |
| $Ce_2(SO_4)_3$ | 0.015 g |
| Ethylene glycol | 8 ml |
| Potassium sulfite | 2.5 g |
| Potassium bromide | 0.8 g |
| Potassium carbonate | 0.2 g |
| Sodium chloride | 25.0 g |
| ST-4 | 0.1 g |
| Hydroxylamine sulfate | 5.0 g |
| Polyphosphoric acid | 2 g |
| Developing agent | as shown in Table 2 |
| Brightening agent (4,4-diaminostilbenedisulfonic acid derivative) | 1.0 g |
| Potassium hydroxide | 2.0 g |
| Diethylene glycol | 15 ml |
| Add water to reach an entire amount of 1l, and adjust to pH 10.20. | |
| **Bleach fixer** | |
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 m |

-continued

| | |
|---|---|
| Adjust to pH 7.1, and add water to reach an entire amount of 1l | |
| Stabilizer | |
| 5-chloro-2-methyl-4-isothiazolin-3-one | 1.0 g |
| Ethylene glycol | 10 g |
| 1-hydroxyethylidene-1,1-diphosphonic acid | 2.5 g |
| Bismuth chloride | 0.2 g |
| Magnesium chloride | 0.1 g |
| Ammonium hydroxide (28% aqueous solution) | 2.0 g |
| Sodium nitrilotriacetate | 1.0 g |

Add water to reach an entire amount of 1l, and adjust to pH 7.0.

It should be noted that stabilization was achieved by the counter flow method using two tanks. Each processed sample was applied to a HITACHI 320 model spectrophotometer equipped with an integral ball to determine the reflection spectral absorption. The wavelength at which an absorbance of 50 was obtained on the short wave side with respect to λ max of spectral absorption was taken as λs' calculated on the basis of the absorbance at λ max taken as 100. λs was then calculated using the equation $\Delta\lambda s = \lambda\ max - \lambda s$. The obtained value, along with λ max, is shown in Table 2.

Each sample was visually observed as to color and rated for suitability for color proof for the printing process.

When the absorbance at λ max is lower than 1.3, the absorbance λ max at λ max at that time is shown instead.

TABLE 2

| Sample number | Cyan coupler content (μmol/dm²) | | Compound of Formula II or solvent (content mg/dm²) | | Developing agent (content m mol/l) | | λmax (nm) | Δλs (nm) | Color suitability for color proof | A max (nm) |
|---|---|---|---|---|---|---|---|---|---|---|
| 1 | CC-1 | (8.0) | SO-2 | (2.0) | DA-1 | (18.0) | 651 | 108 | D (Greenish) | |
| 2 | CC-1<br>C-2 | (5.0)<br>(3.0) | SO-2 | (2.0) | DA-1 | (18.0) | 649 | 115 | D (greenish) | |
| 3 | CC-1 | (8.0) | SO-2 | (2.0) | I-2 | (20.0) | (630) | (118) | D (turbid) | 0.72 |
| 4 | C-2 | (8.0) | SO-2 | (2.0) | I-2<br>DA-1 | (2.0)<br>(18.0) | 647 | 115 | D (greenish) | |
| 5 | CC-1<br>C-2 | (3.0)<br>(5.0) | SO-2 | (2.0) | I-2<br>DA-1 | (18.0)<br>(2.0) | 642 | 104 | C | |
| 6 | C-2 | (8.0) | SO-2 | (2.0) | I-2 | (20.0) | 640 | 102 | C-B | |
| 7 | C-2 | (8.0) | A-32 | (1.0) | I-2 | (20.0) | 647 | 97 | A | |
| 8 | C-2 | (8.0) | A-32 | (2.0) | I-6 | (20.0) | 650 | 96 | B | |
| 9 | C-4 | (8.0) | SO-2 | (1.0) | I-2 | (20.0) | 643 | 99 | B | |
| 10 | C-13 | (8.0) | A-11 | (1.0) | I-2 | (20.0) | 646 | 97 | A | |
| 11 | C-18 | (8.0) | SO-2 | (0.5) | I-10 | (20.0) | 643 | 102 | C-B | |
| 12 | C-31 | (8.0) | A-87 | (1.0) | I-3 | (20.0) | 651 | 100 | B | |
| 13 | C-19 | (8.0) | A-105 | (2.0) | I-2 | (20.0) | 653 | 95 | A | |
| 14 | C-28 | (8.0) | A-105 | (1.0) | DA-1 | (13.0) | 653 | 106 | C | |
| 15 | C-28 | (8.0) | A-18 | (2.0) | I-1<br>I-2 | (12.0)<br>(5.0) | 649 | 100 | B | |
| 16 | C-2 | (8.0) | B-9 | (1.0) | I-6 | (20.0) | 643 | 104 | C | |
| 17 | C-16 | (8.0) | B-4 | (0.5) | I-1 | (20.0) | 645 | 105 | C | |
| 18 | C-12 | (8.0) | B-10<br>SO-2 | (1.0)<br>(1.0) | I-10 | (20.0) | 645 | 102 | C-B | |

NOTE:
DA-1
3-methyl-4-amino-N-ethyl-N-(β-methanesulfonamidoethyl)-aniline sulfate.
Color suitability for color proof is shown with the following symbols:
D: Unsuitable C: Slightly good
B: Good A: Very good As is evident from Table 2, the present invention always gives a smaller value of Δλs and thus provides higher color densities, in comparison with Comparison Examples. Therefore, the present invention is suitable for color proof.

EXAMPLE 2

Layers of the compositions shown in Table 3 were sequentially coated on a paper support laminated with polyethylene on both sides to yield negative type silver halide color photographic light sensitive material sample Nos. 19 through 30.

TABLE 3

| Layer | Composition | Content (g/m²) |
|---|---|---|
| 1st layer: Blue-sensitive layer | Gelatin | 1.2 |
| | Blue-sensitive silver chlorobromide emulsion (average grain size 0.8 μm) | 0.5 |
| | Solvent SO-1 | 0.80 |
| | Yellow coupler YC-1 | 0.80 |
| 2nd layer: Interlayer | Gelatin | 0.70 |
| | Anti-irradiation dye AI-3 | 0.08 |
| | Anti-irradiation dye AI-4 | 0.04 |
| 3rd layer: Green-sensitive layer | Gelatin | 1.25 |
| | Green-sensitive silver chlorobromide emulsion (AgBr 70 mol %) | 0.20 |
| | Solvent SO-1 | 0.30 |
| | Magenta coupler MC-1 | 0.62 |
| 4th layer: Interlayer | Gelatin | 1.20 |
| 5th layer: Red-sensitive layer | Gelatin | 1.20 |
| | Red-sensitive silver chlorobromide emulsion | 0.3 |
| | Compound of Formula II | (as shown in Table 4) |
| | Solvent | |
| | Cyan coupler | |
| 6th layer: UV absorption layer | Gelatin | 1.00 |
| | Solvent dioctyl phthalate | 0.20 |
| | UV absorber UV-1 | 0.30 |
| 7th layer: Protective | Gelatin | 0.50 |

TABLE 3-continued

| Layer | Composition | Content ($g/m^2$) |
|---|---|---|
| layer | | |
| AI-3 | 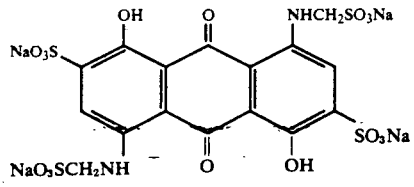 | |

AI-4

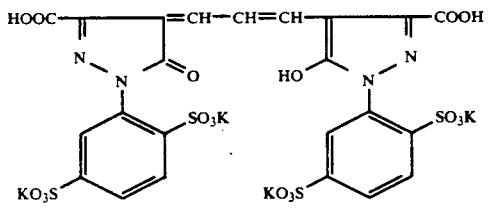

A hardener, 2,4-dichloro-6-hydroxy-s-triazine sodium, was added to the 2nd, 4th and 7th layers so that its content became 0.017 g per g gelatin.

Each of silver halide color photographic light sensitive material sample Nos. 9 through 30 was passed through a blue filter (Wratten No. 26) and an ND filter and exposed to white light, while adjusting the density of the ND filter, so that the absorbance at λ max of the sample's spectral absorption was 1.3±0.02 after the following developing process.

Sample Nos. 19 through 30 were each processed by the following processing procedures.

| | |
|---|---|
| Color development | 2 min. 30 sec. |
| Bleach fixing | 1 min. |
| Stabilization | 1 min. 30 sec. |
| Drying | 60 to 80° C., 2 min. |

The color developer was prepared using the same composition as in Example 1, but the developing agent was as shown in Table 4. The bleach fixer and stabilizer were prepared using the same compositions as in Example 1.

The developed samples were evaluated in the same manner as in Example 1. The results are shown in Table 4.

Also, the absorbance at 430 nm, $A_{430}$, was red from the spectral absorption of each sample. The obtained values are shown in Table 4.

TABLE 4

| Sample number | Cyan coupler content OH ($\mu mol/dm^2$) | Compound of Formula II or solvent (content $mg/dm^2$) | Developing agent (content m mol/l) | λ max (nm) | λ s (nm) | Color suitability for color proof | A max (nm) | $A_{430}$ |
|---|---|---|---|---|---|---|---|---|
| 19 | CC-1 (9.0) | SO-2 (2.0) | DA-1 (18.0) | 651 | 108 | D (greenish) | | 0.48 |
| 20 | CC-1 (9.0) | A-105 (1.0) | DA-1 (18.0) | 659 | 107 | D (greenish) | | 0.49 |
| 21 | CC-1 (6.0)<br>C-2 (3.0) | A-105 (1.0) | I-2 (20.0) | (642) | (101) | D (greenish) | 1.05 | 0.44 |
| 22 | C-2 (9.0) | A-105 (1.0) | DA-1 (18.0) | 654 | 104 | C | | 0.40 |
| 23 | CC-1 (2.0)<br>C-2 (7.0) | SO-2 (2.0) | I-2 (15.0)<br>DA-1 (5.0) | 639 | 104 | C-B | | 0.36 |
| 24 | C-2 (9.0) | A-32 (2.0) | I-2 (20.0)<br>DA-1 (7.0) | 647 | 96 | B | | 0.36 |
| 25 | C-2 (9.0) | A-105 (1.0) | I-2 (20.0) | 646 | 97 | A | | 0.32 |
| 26 | C-2 (9.0) | A-32 (1.0)<br>SO-3 (1.0) | I-1 (20.0) | 148 | 99 | B | | 0.37 |
| 27 | C-4 | A-121 (1.0)<br>SO-2 (1.0) | I-6 (20.0) | 648 | 96 | B | | 0.37 |
| 28 | C-28 | A-125 (1.0)<br>SO-3 (1.0) | I-10 (20.0) | 645 | 101 | B | | 0.33 |
| 29 | C-2 | B-9 (1.0) | I-2 (20.0) | 643 | 102 | B-C | | 0.36 |
| 30 | C-12 | B-17 (2.0)<br>SO-2 (0.5) | I-10 (20.0) | 646 | 104 | C | | 0.39 |

NOTE:
SO-3: Diethyllaurylamide
D: Unsuitable C: Slightly good
B: Good A: Very good The results shown in Table 4 demonstrate that the use of a cyan coupler and developing agent of the present invention in combination reduces the absorption $A_{430}$ of blue light and eliminates the green component to provide a tone similar to that of pure cyan and favorable for color proof. Also demonstrated is that their use in combination with the compound of Formula II reduces Δλs to provide a brighter and vivider color and thus improve color suitability for color proof.

EXAMPLE 3

The 1st through 12th layers of the compositions shown below were coated on a paper support coated with polyethylene on both faces to yield color reversal light sensitive material sample No. 21. The amount of coating for each component is shown in $g/cm^2$. Note that the amount of silver halide is shown as silver content.

| | |
|---|---|
| 1st layer: Gelatin layer | |
| Gelatin | 1.40 |
| 2nd layer: Anti-halation layer | |
| Black colloidal silver | 0.10 |
| Gelatin | 0.60 |
| 3rd layer: First red-sensitive layer | |
| Cyan coupler | As shown in Table 5 |
| High-boiling-point solvent or Compound of Formula II | As shown in Table 5 |
| ArBrI emulsion spectrally sensitized with red-sensitizing dyes RD-1 and RD-2 (AgI content 3.0 mol %, average grain size 0.4 μm) | 0.25 |
| Gelatin | 1.0 |
| 4th layer: First interlayer | |
| Gelatin | 1.0 |

-continued

| | |
|---|---|
| Color mixing preventive agent A-1 | 0.08 |
| 5th layer: First green-sensitive layer | |
| Magenta coupler MC-1 | 0.14 |
| High-boiling-point solvent SO-1 | 0.15 |
| ArBrI emulsion spectrally sensitized with green-sensitizing dyes GD-2 (AgI content 3.0 mol %, average grain size 0.4 μm) | 0.30 |
| Gelatin | 1.0 |
| 6th layer: Second interlayer | |
| Yellow colloidal silver | 0.15 |
| Color mixing preventive agent AS-1 | 0.08 |
| Gelatin | 1.0 |
| 7th layer: First blue-sensitive layer | |
| Yellow coupler YC-1 | 0.6 |
| Oil solution SO-1 | 0.8 |
| AgBrI emulsion spectrally sensitized with blue-sensitizing dyes BD-2 (AgI content 3.0 mol %, average grain size 0.4 μm) | 0.45 |
| Gelatin | 0.70 |
| 8th layer: UV absorption layer | |
| UV absorber UV-1 | 0.2 |
| UV absorber UV-2 | 0.2 |
| UV absorber UV-3 | 0.3 |
| Gelatin | 2.0 |
| 9th layer: Protective layer | |
| Gelatin | 1.0 |

It should be noted that an anti-discoloration agent, a surfactant, a hardener HA-1, and an anti-irradiation dye are contained in addition to the above components.

GD-2

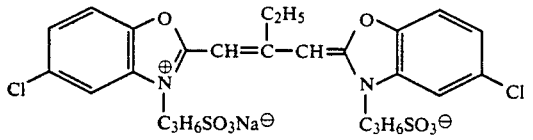

BD-2

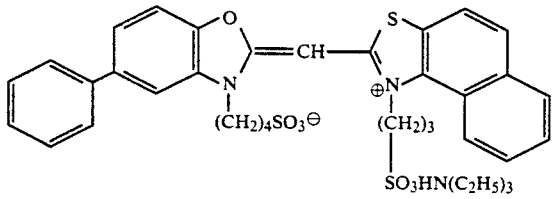

UV absorbers

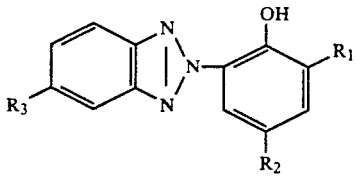

| | $R_1$ | $R_2$ | $R_3$ |
|---|---|---|---|
| UV-2 | (t)$C_4H_9$ | $CH_3$ | Cl |
| UV-3 | (t)$C_4H_9$ | (t)$C_4H_9$ | Cl |

Sample Nos. 31 through 38 were each exposed in the same manner as in Example 1 and subjected to the following processing procedures.

| | |
|---|---|
| Primary development | 1 min. 15 sec. (38°) |

-continued

| | |
|---|---|
| (monochrome development) | |
| Washing | 1 min. 30 sec. |
| Light fogging, 100 lux | Over 1 second |
| Secondary development (color development) | 2 min. 15 sec. (38°) |
| Bleach fixing | 2 min. (38° C.) |
| Washing | 2 min. 15 sec. |
| Primary developer | |
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Sodium hydrogencarbonate | 12 g |
| 1-phenyl-4-methyl-4-hydroxymethyl-3-pyrrazolidone | 1.5 g |
| Hydroquinone monosulfonate | 23.3 g |
| Add water to reach 1.01 (pH = 9.65) | |
| Color developer | |
| Benzyl alcohol | 14.6 ml |
| Ethylene glycol | 12.6 ml |
| Potassium carbonate (anhydrous) | 26 g |
| Sodium hydroxide | 1.6 g |
| Sodium sulfite | 1.6 g |
| 3,6-dithiaoctane-1,8-diol | 0.24 g |
| Hydroxylamine sulfate | 2.6 g |
| Developing agent | As shown in Table 5 |
| Bleach fixer | |
| Solution of 1.56 mol of ammonium salt of ferric complex of ethylenediaminetetraacetate | 115 ml |
| Sodium metabisulfite | 15.4 g |
| Ammonium thiosulfate (58%) | 126 ml |
| 1,2,4-triazole-3-thiol | 0.4 g |
| Add water to reach 1.01 (pH = 6.5) | |

The processed samples were evaluated in the same manner as in Example 1. The results are shown in Table 5.

TABLE 5

| Sample | Cyan coupler content | Compound of Formula II or solvent | Developing agent | λ max | Δλ s | Color suitability | A max |
|---|---|---|---|---|---|---|---|

TABLE 5-continued

| number | (μmol/dm²) | | (content mg/dm²) | | (content m mol/l) | | (nm) | (nm) | for color proof | (nm) |
|---|---|---|---|---|---|---|---|---|---|---|
| 31 | CC-1 | (8.0) | SO-2 | (2.0) | DA-1 | (18.0) | 651 | 109 | D (greenish) | |
| 32 | CC-2 | (8.0) | A-105 | (2.0) | I-2 | (20.0) | 651 | 107 | D (greenish) | 1.08 |
| 33 | C-2 | (8.0) | A-105 | (1.0) | I-2 | (20.0) | 648 | 96 | A | |
| 34 | C-7 | (8.0) | A-10 | (2.0) | I-10 | (18.0) | 652 | 102 | B | |
| | | | SO-2 | (0.5) | | | | | | |
| 35 | C-12 | (8.0) | A-11 | (1.0) | I-11 | (18.0) | 648 | 100 | B | |
| | | | SO-2 | (0.5) | | | | | | |
| 36 | C-18 | (8.0) | A-70 | (1.0) | I-9 | (18.0) | 647 | 99 | B | |
| | | | SO-2 | (0.5) | | | | | | |
| 37 | C-22 | (8.0) | A-87 | (1.0) | I-6 | (18.0) | 642 | 103 | B | |
| | | | SO-2 | (0.5) | | | 650 | | | |
| 38 | C-29 | (8.0) | A-98 | (2.0) | I-5 | (18.0) | 653 | 102 | B | |
| | | | SO-2 | (0.5) | | | | | | |

CC-2

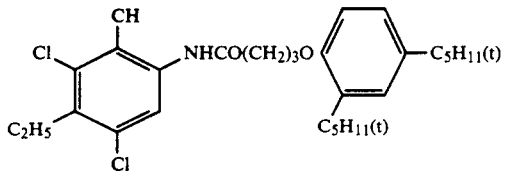

The results shown in Table 5 demonstrate that the method of color image formation of the present invention reduces that Δλs of cyan coloration to provide a vivid color and a tone favorable for color proof.

EXAMPLE 4

Sequential coating on a paper support and drying were conducted in the same manner as in Example 1, but a compound of the following structure, as fogging agent, was added to the 3rd, 5th and 9th layers of Example 1 at a ratio of 200 mg per mol silver halide.

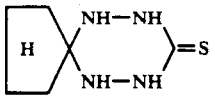

The synthesis method for this fogging agent is described in U.S. Pat. No. 4139387 and the Research disclosure (RD) 15750 (1977).

The silver halide color photographic material sample produced as above was exposed in the same manner as in Example 1 and then processed as follows:

| | | |
|---|---|---|
| Color development | 38° C. | 2 min. 30 sec. |
| Bleach fixing | 35° C. | 60 sec. |
| Stabilization | 25 to 30° C. | 1 min. 30 sec. |
| Drying | 72 to 80° C. | 1 min. |
| Color developer | | |
| Water | | 800 l |
| Phosphoric acid (85%) | | 9 l |
| Benzyl alcohol | | 10 ml |
| Ethylene glycol | | 15 ml |
| Hydroxylamine sulfate | | 5.0 g |
| Diethylenetriamine pentaacetate | | 2 g |
| Sodium chloride | | 0.2 g |
| Potassium bromide | | 1.5 g |
| Potassium hydroxide (40%) | | 42 ml |
| Potassium sulfite | | 2.0 g |
| Developing agent shown in Table 2 | | 5.5 g |
| Brightening agent (4,4'-diaminostilbenedisulfonic acid derivative) | | 1.0 g |

Add water to reach 1l, and adjust to pH11.80.

The bleach fixer and stabilizer were prepared in the same manner as in Example 1.

The processed sample was evaluated in the same manner as in Example 1; the effect of the present invention was confirmed as in Example 1.

What is claimed is:

1. A process for forming a color image comprising;

imagewise exposure of a photographic material which comprises a light-sensitive silver halide emulsion layer containing a 2,5-diacylaminophenol-based cyan coupler at a ratio of over 50 mol % of the total cyan coupler in the photographic material and compound selected from a group consisting of Formula V and Formula VI:

$$R_{16}—NHSO_2—R_{17} \qquad V$$

wherein $R_{16}$ and $R_{17}$ independently represent an alkyl or aryl group which may be substituted;

VI

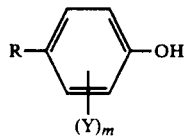

wherein R represents an alkyl, alkoxycarbonyl, arylsulfonylamino or alkylsulfonylamino group, Y represents a substituent; and color developing the exposed photographic material with a color developer containing a color developing agent represented by Formula I at a ratio of over 55 mol % of total developing agent in the color developer.

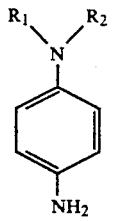

I wherein $R_1$ and $R_2$ independently represent a substituted or unsubstituted alkyl group, and $R_1$ and $R_2$ may link together to form a ring.

2. A process for forming a color image as claimed in claim 1, wherein $R_1$ represents an unsubstituted alkyl group and $R_2$ represents a hydroxyalkyl group.

3. A process for forming a color image as claimed in claim 1, wherein one of $R_1$ and $R_2$ is contains a substituent selected from the group consisting of $-(CH_2)n-CH_2OH$, $-(CH_2)m-NHSO_2-(CH_2)-CH_3$, $-(CH_2)m-O-(CH_2)\ n-CH_3$, $-(CH_2CH_2O)nCmH_{2m+1}$, $-COOH$ or $-SO_3H$, wherein m and n independently represent an integer of 0–6.

4. A process for forming a color image as claimed in claim 3, wherein one of $R_1$ and $R_2$ is an unsubstituted alkyl group.

5. A process for forming a color image as claimed in claim 1, wherein the ratio of the color developing agent represented by Formula I is over 70 mol % to total developing agent in the color developer.

6. A process for forming a color image as claimed in claim 1, wherein the 2,5-diacylaminophenol-based cyan coupler is represented by Formula III,

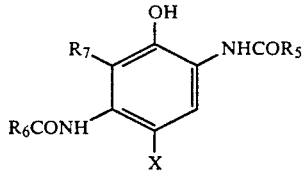

III wherein $R_5$ and $R_6$ independently represent an alkyl, cycloalkyl, alkenyl, aryl or heterocyclic group, $R_7$ represents a hydrogen or halogen atom, an alkyl or alkoxy group, $R_6$ and $R_7$ may link to form a ring; X represents a hydrogen atom or a group of splitting off by reaction with an oxidation product of color developing agent.

7. A process for forming a color image as claimed in claim 1, wherein the ratio of the 2,5-diacylaminophenol-based cyan coupler is over 70 mol % to total cyan coupler in the photographic material.

8. A process for forming a color image as claimed in claim 1, wherein the photographic material comprises a compound represented by Formula V, $$R_{16}-NHSO_2-R_{17} \qquad V$$

wherein $R_{16}$ and $R_{17}$ independently represent an alkyl or aryl group which may be substituted.

9. A process for forming a color image as claimed in claim 1, wherein the photographic material comprises a compound represented by Formula VI,

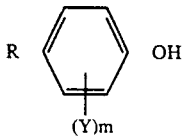

VI wherein R represents an alkyl, alkoxycarbonyl, arylsulfonylamino or alkylsulfonylamino group, Y represents a substituent.

* * * * *